US005611315A

United States Patent [19]

Dohta et al.

[11] Patent Number: 5,611,315

[45] Date of Patent: Mar. 18, 1997

[54] FUEL SUPPLY AMOUNT CONTROL APPARATUS FOR INTERNAL COMBUSTION ENGINE

[75] Inventors: Hisayo Dohta, Kariya; Katsuhiko Kawai, Nagoya, both of Japan

[73] Assignee: Nippondenso Co., Ltd., Kariya, Japan

[21] Appl. No.: 540,186

[22] Filed: Oct. 6, 1995

[30] Foreign Application Priority Data

Oct. 24, 1994 [JP] Japan ..... 6-284258
Aug. 3, 1995 [JP] Japan ..... 7-198250

[51] Int. Cl.[6] ..... F02D 41/10; F02D 41/12

[52] U.S. Cl. ..... 123/492

[58] Field of Search ..... 123/478, 480, 123/492, 493

[56] References Cited

U.S. PATENT DOCUMENTS

| | | | |
|---|---|---|---|
| 4,667,640 | 5/1987 | Sekozawa et al. | 123/492 |
| 4,852,538 | 8/1989 | Nagaishi | 123/492 |
| 4,953,530 | 9/1990 | Manaka et al. | 123/492 |
| 4,995,366 | 2/1991 | Manaka et al. | 123/492 |
| 5,080,071 | 1/1992 | Minamitani et al. | 123/492 |
| 5,134,983 | 8/1992 | Kusunoki et al. | 123/492 |
| 5,239,974 | 8/1993 | Ebinger et al. | 123/492 |
| 5,243,948 | 9/1993 | Schnaibel et al. | 123/492 |
| 5,494,019 | 2/1996 | Ogawa | 123/492 |

FOREIGN PATENT DOCUMENTS

| | | |
|---|---|---|
| 1-216042 | 3/1989 | Japan . |
| 3-111639 | 5/1991 | Japan . |
| 4-252833 | 9/1992 | Japan . |
| 5-99029 | 4/1993 | Japan . |

*Primary Examiner*—Willis R. Wolfe
*Attorney, Agent, or Firm*—Cushman, Darby & Cushman, IP Group of Pillsbury Madison & Sutro LLP

[57] ABSTRACT

A fuel supply amount control apparatus improves controllability during engine acceleration and deceleration and immediately after starting the operation of the engine, by enabling the setting of suitable parameters. An evaporation time constant indicating chronological changes in the fuel amount introduced into a cylinder from an intake system of the engine is computed by a predetermined computation equation. During this computation, the computation load is reduced by using an Aquino operator α and a stroke interval Aquino operator Aα and computation for computing the fuel injection amount is executed at an interval shorter than the interval of two successive fuel injections, e.g., a crank angle of 60°. During computation of the evaporation time constant, the evaporation time constant after full warm-up is corrected based on an average temperature weighted according to an adherence rate of fuel to the intake manifold and intake valve. The intake valve temperature, since it increases according to input heating energy, is estimated from the injected fuel amount.

11 Claims, 15 Drawing Sheets

| Pm(mmHg) | 290 | 369 | 447 | 525 | 603 | 681 | 759 |
|---|---|---|---|---|---|---|---|
| f(Pm) OF $\tau$ | 1.00 | 1.35 | 1.54 | 1.80 | 1.98 | 2.08 | 2.20 |

Pmo = 290mmHg

Pm
t

Tsw
t

T
t n
t

Δn
t

Q
ΔQ
t

A/F
Tc
t

| | Ne1 | Ne2 | Ne3 | ---- | ---- | ---- |
|---|---|---|---|---|---|---|
| Pm1 | ηmap11 | ηmap12 | ηmap13 | ---- | ---- | ---- |
| Pm2 | ηmap21 | ηmap22 | ---- | ---- | ---- | ---- |
| Pm3 | ηmap31 | ---- | ---- | ---- | ---- | ---- |
| Pm4 | ηmap41 | ---- | ---- | ---- | ---- | ---- |
| Pm5 | ηmap51 | ---- | ---- | ---- | ---- | ---- |

FUEL SUPPLY AMOUNT CONTROL APPARATUS FOR INTERNAL COMBUSTION ENGINE

BACKGROUND OF THE INVENTION

1. Field of the Invention

The present invention relates to a fuel supply amount control apparatus for an internal combustion engine for controlling a fuel amount to be injected into the internal combustion engine, and in particular to one which determines a fuel injection amount in consideration of the behavior of fuel injected into an intake system.

2. Description of the Related Art

In the prior art, the apparatus disclosed in Unexamined Japanese Patent Application Publication No. H1-216042 and the apparatus etc. disclosed in Unexamined Japanese Patent Application Publication No. H4-252833, for example, are known as such type of control apparatus, i.e. a control apparatus for controlling a fuel supply amount to an internal combustion engine based on the behavior of the fuel injected into the intake system thereof.

Either of these fuel supply amount control apparatuses computes a residual fuel amount remaining in the intake system at the next fuel injection time using a fuel behavior model for expressing as an equation the behavior of fuel injected into the intake system of the internal combustion engine from a fuel injection valve when it is introduced into a cylinder while evaporating due to the opening of an intake valve. The injected fuel amount to actually be injected is computable if the residual fuel amount from the previous injection remaining in the intake system at the time of the next injection of fuel is determined, since the fuel amount required for the internal combustion engine is measurable based on the operating conditions of the internal combustion engine and the target value of the air-fuel ratio thereof is measurable.

As a fuel behavior model described above, there is the following known equation (1). This equation is established based on the two points that a fuel amount MF(t) remaining in the intake system at a given time corresponds to the addition of an injected fuel amount GF during one stroke to a remaining fuel amount not introduced into the cylinder in the previous injected fuel amount, and that a large portion of the fuel injected into the intake system adheres to the inner wall of the intake system and is introduced into the cylinder in order while evaporating together with the opening of the intake valve, thus this remaining fuel amount can be understood as the amount of chronological or time-dependent change based on a given time constant.

$$MF(t)=MF(t-\Delta t)\bullet e^{-\Delta t/\tau}+GF \quad (1)$$

In this equation (1) $\tau$ is a time constant (herebelow referred to as "evaporation time constant") indicating chronological change in the fuel amount introduced into the cylinder from the intake system of the internal combustion engine after injection of fuel by the fuel injection valve, $\Delta t$ is time corresponding to a general crank angle of 720° or an integral multiple thereof in a sampling cycle (computation cycle), and GF indicates an injected fuel amount of the previous one stroke. Here, conventionally, the evaporation time constant $\tau$, which is what is called two-dimensionally mapped, is a parameter determined based on the operating conditions of the internal combustion engine, and this is stored in a memory of the control apparatus to make a suitable read-out structure. However, the above-described control apparatuses have the following problems which must be resolved.

Developmental Inefficiencies

Conventionally, the evaporation time constant $\tau$ is experimentally determined by operating the internal combustion engine based on various conditions, and produced as a two-dimensional map based thereon. Due to this, there are the disadvantages that many man-hours are required for this production and again, a great deal of labor is necessary for the correction of such maps. This means that development of a suitable fuel injection apparatus requires a great deal of labor and expense and is therefore inefficient.

Control problem at times of acceleration/deceleration

In addition, in the conventional control apparatuses, the above well-known equation is used as a C. F. Aquino equation to compute the fuel amount adhered to the intake system of the internal combustion engine per every crank angle of 720° or per every multiple thereof, determining the fuel amount to be injected into the engine based on this obtained fuel amount. However, at times of transition where engine operating conditions change moment by moment even at intervals less than the crank rotation angle of 720°, especially during acceleration, deceleration and the like, the pressure of the intake system rapidly changes and the flow speed of air flowing into the intake system also changes rapidly, therefore the chronological change of the fuel amount actually flowing into the cylinder from the intake system differs from that at times of steady state operation. Due to this, in the conventional control apparatus which performs computation per every crank angle of 720° based on the evaporation time constant $\tau$ at a constant operating time, there is the problem that the residual fuel amount at times of transition cannot be correctly understood and, ultimately, a suitable fuel injection amount at transitional times cannot be computed.

Control problem immediately after starting

Further, since a large portion of the fuel introduced into the cylinder adheres to the inner wall of the intake system (inner wall of the intake manifold and intake valve) and evaporates in the intake air flow, the evaporation time constant $\tau$ is greatly affected by the temperature of the inner wall of the intake system. The intake manifold has a direct heat transfer relationship with a cooling system of the internal combustion engine, therefore temperature changes thereof can be relatively easily known by measuring the temperature of the cooling water for example. Conventionally, control methods which measure the cooling water temperature and correct the fuel injection amount based thereon have been tried.

However, a certain proportion of the injected fuel also adheres to the intake valve. The intake valve temperature changes at a time constant remarkably smaller than the intake manifold temperature. Therefore, under conditions where the valve temperature differs from normal, such as for example immediately after start of operation of the internal combustion engine etc., there is the problem that the residual fuel amount in the intake system cannot be correctly recognized and a suitable fuel injection amount cannot be computed.

SUMMARY OF THE INVENTION

The present invention was conceived in light of the above situation and its object is to provide a fuel injection control apparatus for an internal combustion engine which can appropriately determine a parameter (evaporation time constant $\tau$) for control, can be effectively developed, and which can appropriately control the amount of injected fuel even at times of acceleration and deceleration.

Also, another object is to provide a fuel injection control apparatus for an internal combustion engine which can suitably perform control even immediately after starting the internal combustion engine.

A first aspect of the present invention provides a fuel injection apparatus for an internal combustion engine which has an evaporation time constant computing means for computing an evaporation time constant indicating changes over time of a fuel amount introduced into a cylinder from an intake system after injection of fuel by a fuel injection valve, according to the revolutions or rotational speed of the internal combustion engine and the load of the internal combustion engine at a predetermined reference internal combustion engine rotational speed and a reference internal combustion engine load and at an evaporation time constant computing time.

In the present invention, simply by previously setting the evaporation time constant of operating conditions determined as references (reference internal combustion engine rotational speed and reference internal combustion engine load) as the reference evaporation time constant, evaporation time constants under other operating conditions can be obtained by computation.

As a result the man-hours and labor for creating a map of evaporation time constants for all regions can be eliminated. Also, because the internal combustion engine rotational speed and internal combustion engine load which affect the evaporation time constant are taken into consideration in the computation of the evaporation time constant, there is no reduction of reliability.

In a second aspect of the present invention, the evaporation time constant $\tau$ is computed by the equation $$\tau=\tau 0\bullet(NeO/Ne)\bullet f(Pm) \quad (2)$$

(Here, Ne is an internal combustion engine rotational speed at a time of computing, Pm is an intake pressure at the time of computing, NeO is a reference internal combustion engine rotational speed, $\tau 0$ is a reference evaporation time constant at a reference intake pressure Pm0 as the reference internal combustion engine rotational speed Ne0 and a reference internal combustion engine load, and f(Pm) is a rate of change of the evaporation time constant $\tau$ with respect to the intake pressure Pm with the evaporation time constant $\tau$ at the reference intake pressure Pm0 as a reference.)

In other words, taking the injection of fuel prior to an intake stroke of the internal combustion engine as finishing, during the fuel injection time the intake valve is closed and during that time injected fuel is partially adhered to the inner wall of the intake system without fuel entering the cylinder. As the parameters for expressing the behavior of the fuel in the intake system of the internal combustion engine, the two parameters of an adherence rate x which is the percentage of fuel adhering to the inner wall of the intake system among the injected fuel, the degree of chronological change in the fuel adhering to the inside of the cylinder in an intake stroke among the adhered fuel, i.e. the evaporation time constant $\tau$, must be considered. It is to be noted that with regard to the above adherence rate x of fuel, it is appropriate for the sake of simplification to set this at x=1 (fixed value).

Examining the behavior of the fuel adhered to the inner wall of the intake system being introduced into the cylinder, the adhered fuel evaporates in the space within the intake system and is introduced into the cylinder as fuel gas, and is introduced even as liquid along with the air flow into the cylinder. Consequently, the evaporation time constant $\tau$ which indicates the chronological change rate of fuel introduced into the cylinder comprises a section which contributes to a fuel evaporation phenomenon from the injection of the fuel to the end of the intake stroke and a portion which contributes to an intake phenomenon by liquid droplets. Here, taking the evaporation time constant of the portion contributing to the evaporation phenomenon as $\tau 1$, this is in proportion to the intake pressure Pm of the internal combustion engine. In other words, $$\tau\propto Pm \quad (3)$$

Meanwhile, the phenomenon of liquid droplets entering the cylinder as is along with the gas flow is affected by the gas flow speed, this gas flow speed has the following relationship with the rotational speed Ne of the internal combustion engine at that time.

$$\text{Gas flow speed}\propto Ne\bullet Pm \quad (4)$$

Therefore, based on the liquid droplet introduction phenomenon, taking the evaporation time constant as $\tau 2$, $\tau 2$ is determined as $$\tau 2=f(Ne, Pm)\propto 1/(Ne\bullet Pm) \quad (5)$$

The relationship of the time constant $\tau 2$ by this liquid droplet introduction phenomenon to the above rotational speed Ne and intake pressure Pm, taking the intake pressure as a constant, is $$\tau 2\propto 1/Ne \quad (6)$$

and taking the rotational speed Ne as a constant, it is $$\tau 2\propto 1/Pm \quad (7)$$

By means of the above relationships, summarizing the relationship of the time constants $\tau 1$ and $\tau 2$, the following results can be obtained as the value of the evaporation time constant $\tau$.

(i) The time constant $\tau$ when the intake pressure Pm is fixed $$\tau 1=\text{const (fixed value } \tau 2\propto 1/Ne \quad (8)$$

whereby $$\tau\propto 1/Ne \quad (9)$$

(ii) The time constant $\tau$ when the rotational speed Ne are fixed $$\tau 1\propto Pm\ \tau 2\propto 1/Pm \quad (10)$$

In this case, the inclination or tendency of the time constants $\tau 1$ and $\tau 2$ are in opposite directions in relation to the intake pressure Pm, the inclination of the time constant $\tau$ being determined by the dependency of these time constants $\tau 1$ and $\tau 2$. Thereby, $$\tau=f(Pm) \quad (11)$$

in the engine which has a large dependency on the time constant $\tau 1$ being $$\tau\propto Pm \quad (12)$$

and conversely in the engine which has a large dependency on the time constant $\tau 1$ being $$\tau \propto 1/Pm \quad (13)$$

Summarizing the results of (i) and (ii), the following is obtained $$\tau = \tau 0 \bullet (Ne0/Ne) \bullet f(Pm) \quad (14)$$

However, in this equation (14), Ne0 is the rotational speed which are the reference for the engine, τ0 is the evaporation time constant at the reference rotational speed Ne0 and reference intake pressure Pm0, and f(Pm) is the rate of change of the evaporation time constant τ with respect to the intake pressure Pm with the evaporation time constant τ at the reference intake pressure Pm0 as a reference.

Since the evaporation time constant τ is determined in this manner, if the reference rotational speed Ne0, the reference intake pressure Pm0, the evaporation time constant τ0 and the rate of change f(Pm) of the evaporation time constant τ under these conditions are previously determined, the evaporation time constant τ at that time can be computed based on the rotational speed Ne and intake pressure Pm at that time using the above equation (14). Upon the evaporation time constant τ being computed by the evaporation time constant computing means, the fuel amount remaining in the intake system of the internal combustion engine is computed based on this value, and the fuel amount to be injected is computed from this residual fuel amount and a required fuel amount computed according to operating conditions of the internal combustion engine.

It is to be noted that being able to obtain an evaporation time constant τ at each point in time by the above-described computation indicates that the evaporation time constant τ under arbitrary operating conditions can be computed for any arbitrary time even without making a map of each evaporation time constant based thereon, if the above parameters Ne0, Pm0, τ0 and f(Pm) are experimentally determined. Also, correction for this adaptation may be correction of the value of each parameter and is very easy.

Since the evaporation time constant τ at arbitrary times is computable in this way, the computation load of the evaporation time constant and the residual fuel amount based thereon can be alleviated.

In the third aspect of the present invention, when computing the residual fuel amount, means for computing the residual fuel amount by adding an injection fuel amount to a value obtained by multiplying the following operator α defined in the following equation to the residual fuel amount at a previous fuel injection time is provided.

$$\alpha = 1 - (\Delta t/\tau) \quad (15)$$

(Here, Δt is a sampling cycle and τ is the evaporation time constant.) This Aquino operator α resembles the approximation of the power term of e in the equation (1), and can relieve the computation load of the residual fuel amount.

Also, in the fourth aspect of the present invention, by providing a means for computing the residual fuel amount by using another Aquino operator Aα between the times in the following equation, the residual fuel amount can be computed by repetition of a simple multiplication per each sampling. Further, the computation load of the residual fuel amount can be reduced.

$$A\alpha = \alpha(t) \bullet \alpha(t-\Delta t) \bullet \alpha(t-2\Delta t) \ldots \alpha(t-n\Delta t) \quad (16)$$

(Here, Δt is a sampling cycle and n is a sampling frequency of one stroke or time period.)

Also, in the fifth aspect of the present invention, a computation for computing the evaporation time constant and the fuel injection amount based thereon is executed in the fuel injection period of the internal combustion engine or a time period shorter than the fuel injection period. Thereby, a suitable fuel injection amount can be computed even in times of transition of engine operating conditions.

Further, in the sixth aspect of the present invention, means for correcting the evaporation time constant based on the temperature of the intake system is provided. By means of this, a suitable evaporation time constant can be computed even when a state of thermal equilibrium immediately after starting operation, for example, has not been reached.

Further still, in the seventh aspect of the present invention, a fuel adhesion portion average temperature computing means computes an average temperature of fuel adhesion portions by weighting the temperature of the intake system and the temperature of the intake valve according to an adhesion rate of fuel onto the intake system and intake valve of fuel injected from the fuel injection valve, and correction means corrects the evaporation time constant based on the computed average temperature.

As a result, immediately after the start of operation of the internal combustion engine, although the intake manifold slowly increases in temperature and the intake valve section rapidly increases in temperature, the evaporation time constant τ can be corrected to a more suitable level. It is to be noted that the above adhesion rate of fuel is reached by the size of the intake valve and fuel injection timing as well as the attachment position and injection direction of the fuel injection valve, and can be suitably set for the internal combustion engine to which it is applied.

Also, according to the eighth aspect of the present invention, intake valve temperature measuring means for estimating an intake valve temperature based on an integrated value of the injected fuel from start of operation. Thereby, direct temperature measuring means such as a temperature sensor is not necessary.

In addition, in the ninth aspect of the present invention, the fuel injection amount computing means computes a correction amount of the fuel injection amount according to a change delay of filling efficiency of air taken into the cylinder at times of fluctuation of the internal combustion engine load, and fuel injection amount correction means corrects the fuel injection amount based on the correction amount. By such means, because computation errors of the fuel injection amount arising from changes in filling mixture charging efficiency are corrected irrespective of the load at a time of load change reaching a steady state, a suitable fuel injection amount can be computed even at times of load change.

Further, in the tenth aspect of the present invention, the correction amount of the fuel injection amount is computed based on a first-order lag amount of the load of the internal combustion engine. Since computational errors of the fuel injection amount are computed based on the first-order lag of the load in such a way, it is not necessary to directly obtain computational errors by means of change delays in charging efficiency. It is to be noted that because change delays in charging efficiency give rise to change delays in the cylinder wall temperature, in order to directly obtain computational errors by means of change delays in charging efficiency, means for detecting the cylinder wall temperature is additionally required.

Further still, in the eleventh aspect of the present invention, there is a structure which computes the fuel injection amount by means of a pole assignment method.

BRIEF DESCRIPTION OF THE ACCOMPANYING DRAWINGS

These and other features, aspects and advantages of the present invention will become better understood with reference to the following description, appended claims and accompanying drawings, in which:

Figure 12:
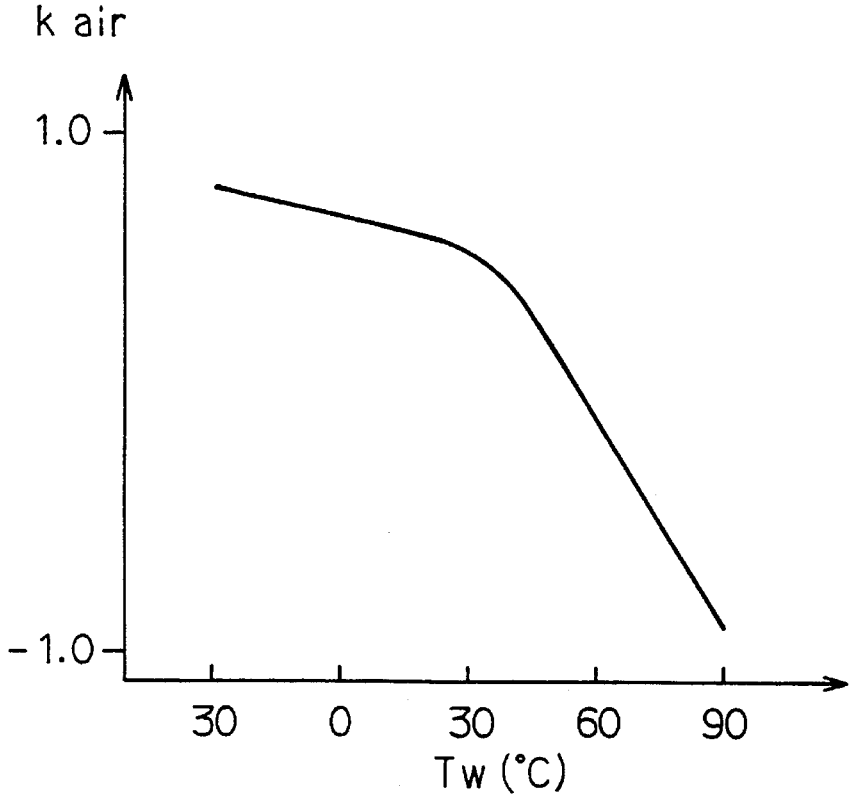
Figures 11A, 11B, 11C, 11D, 11E, 11F, 11G:
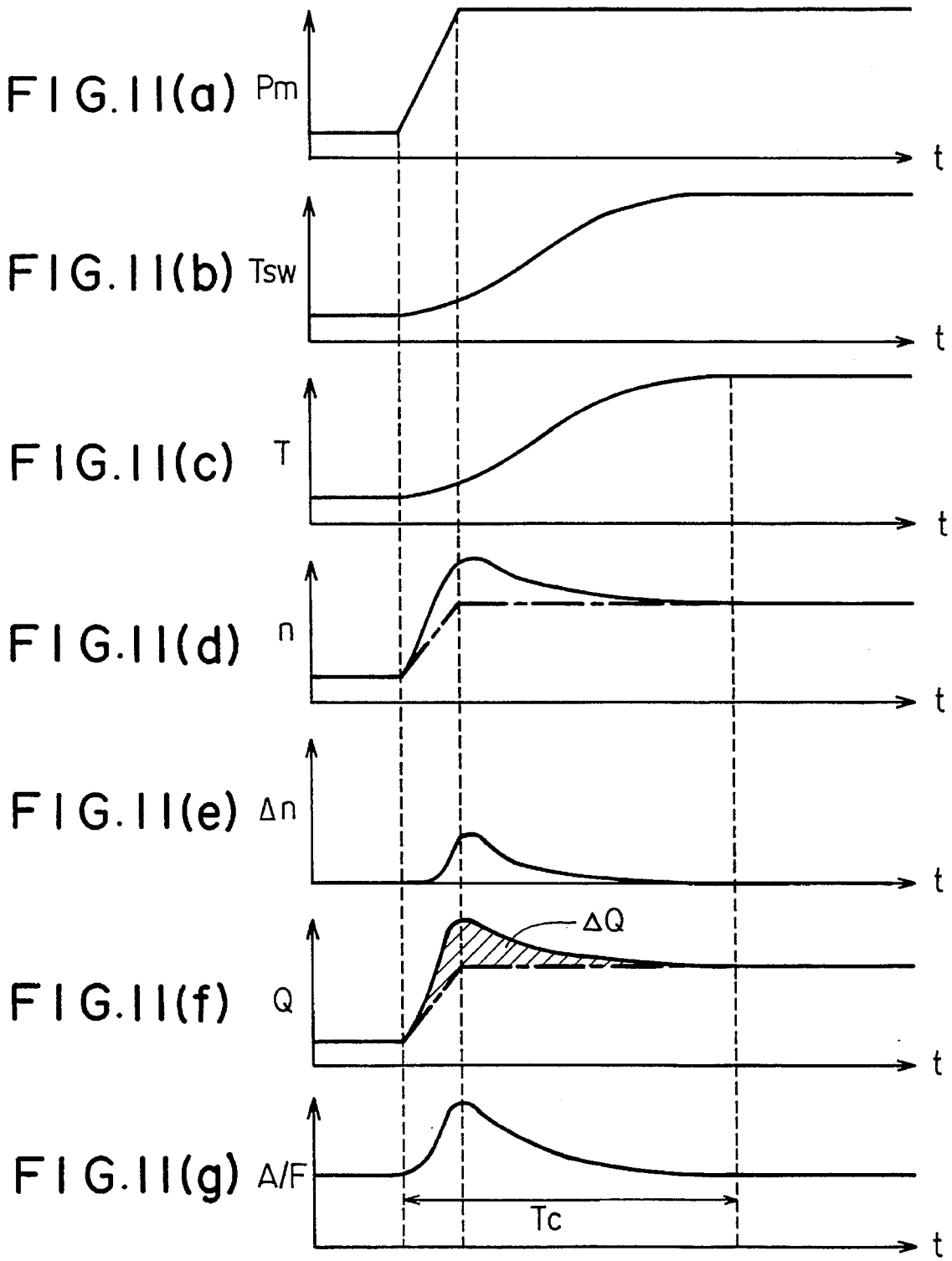
Figure 13:
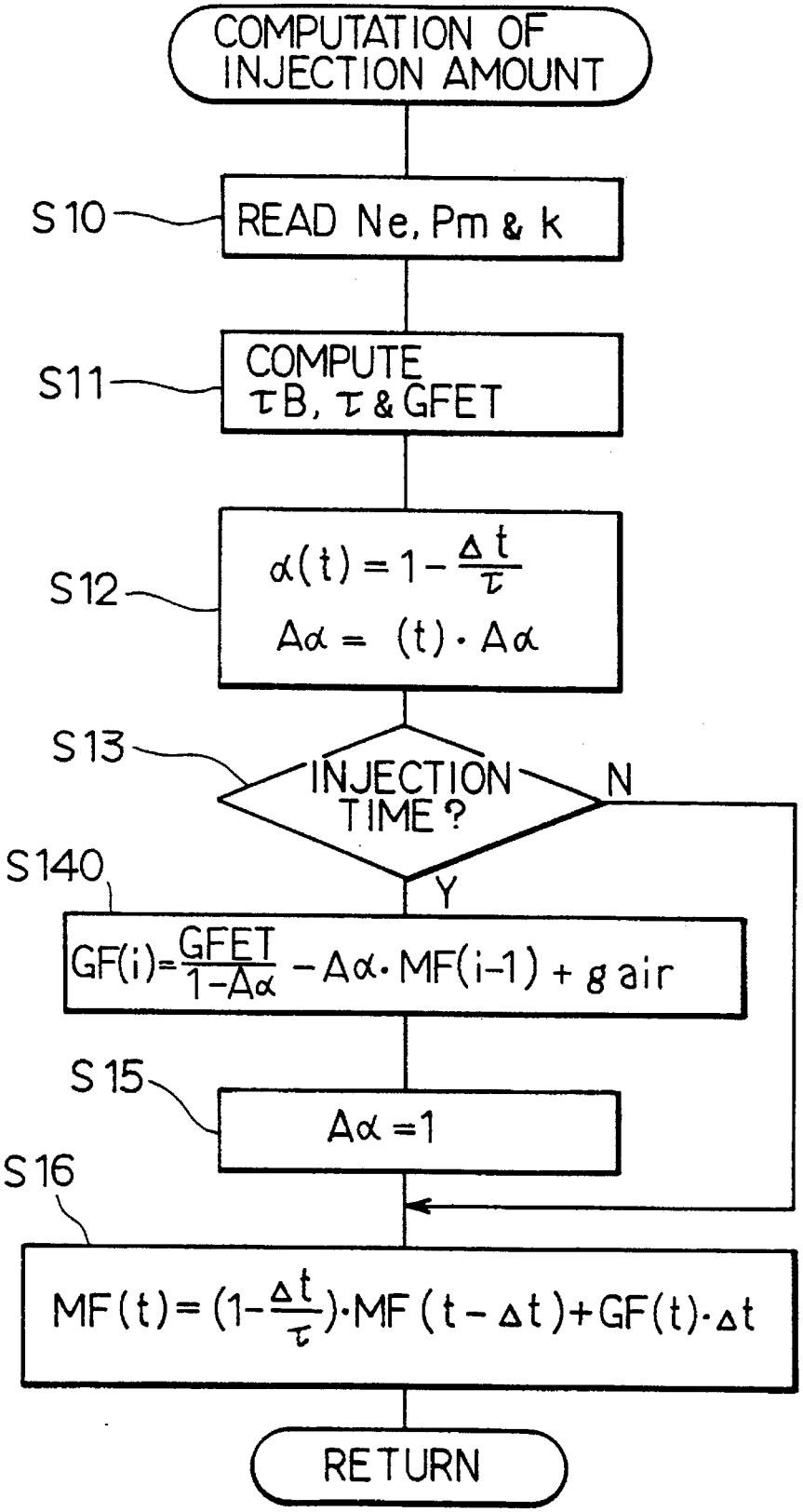
Figure 14:
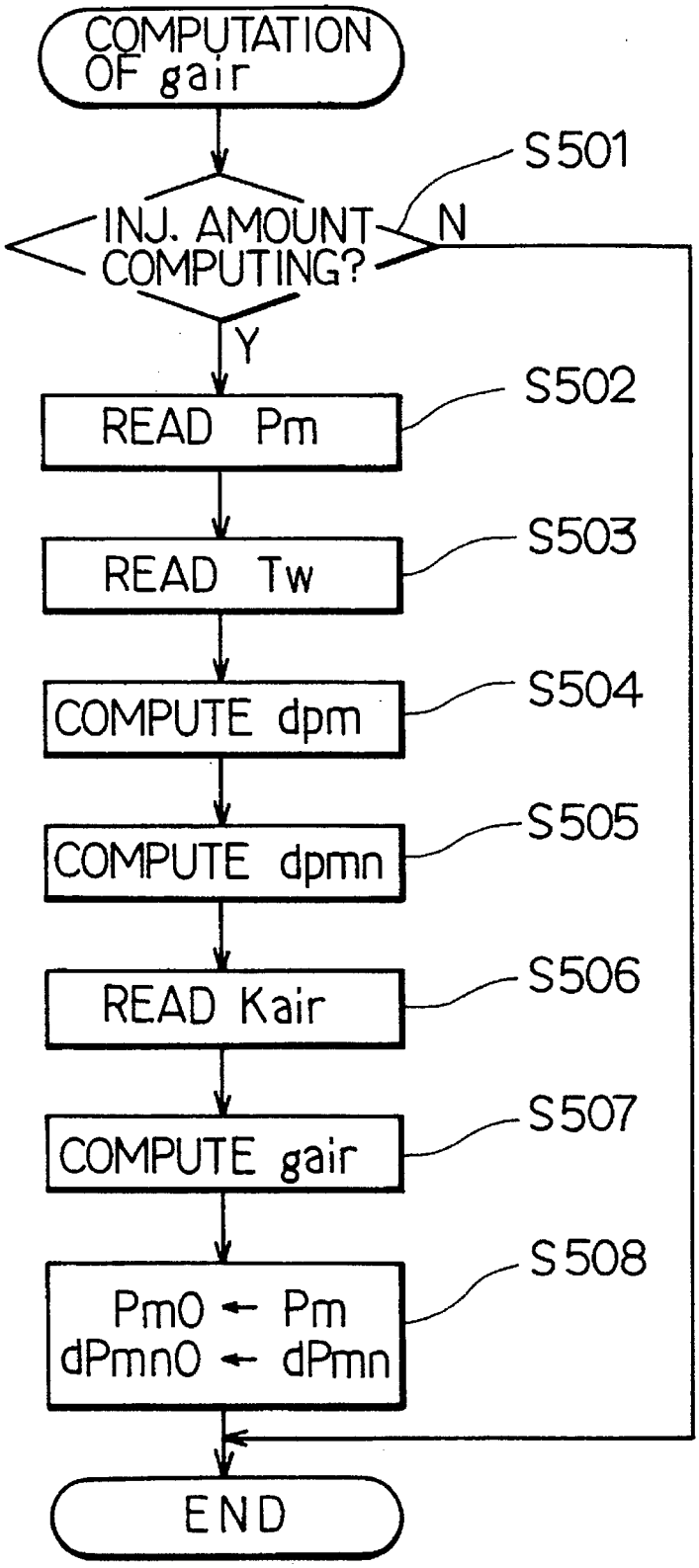
Figure 18:
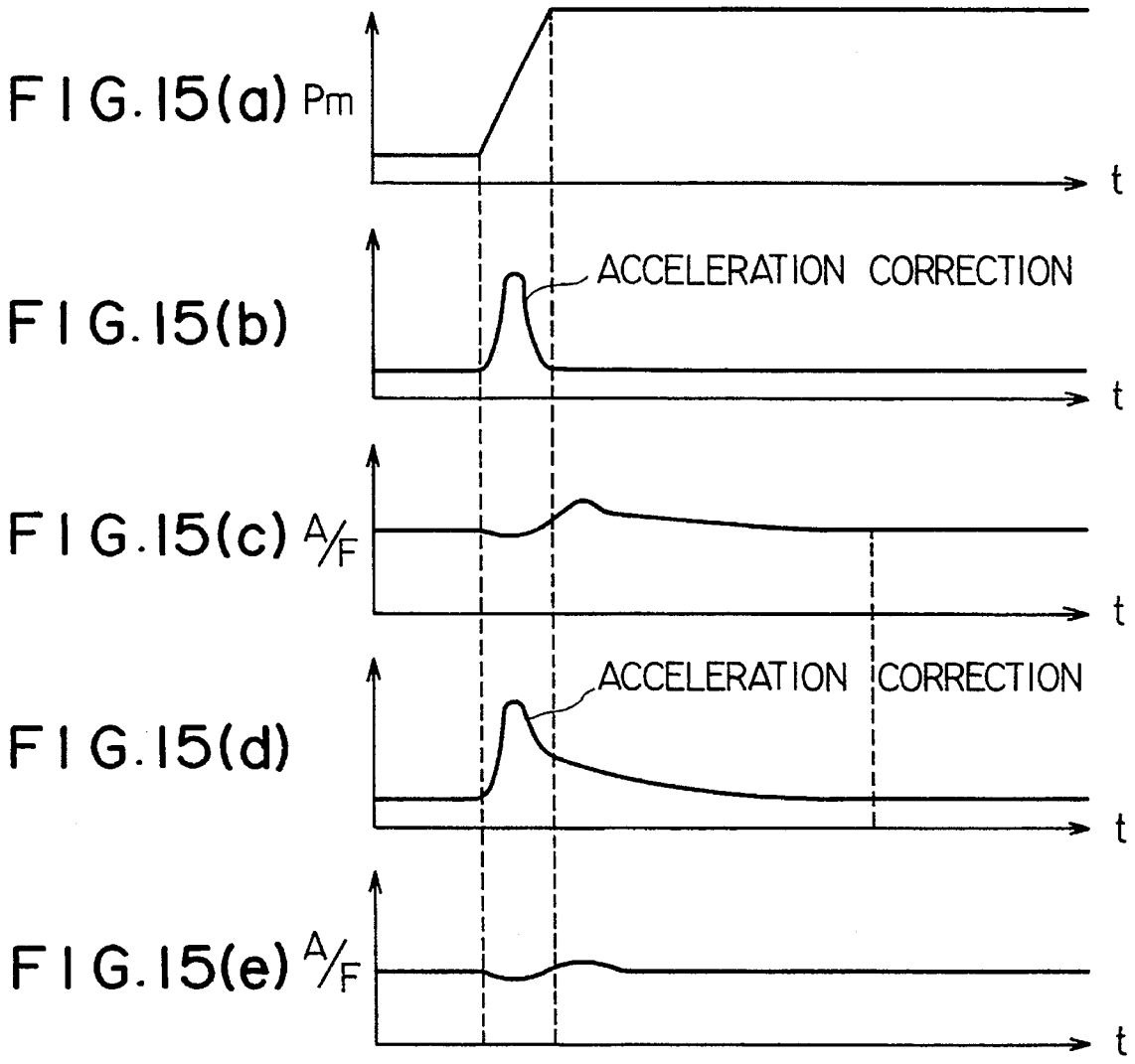
Figure 16:
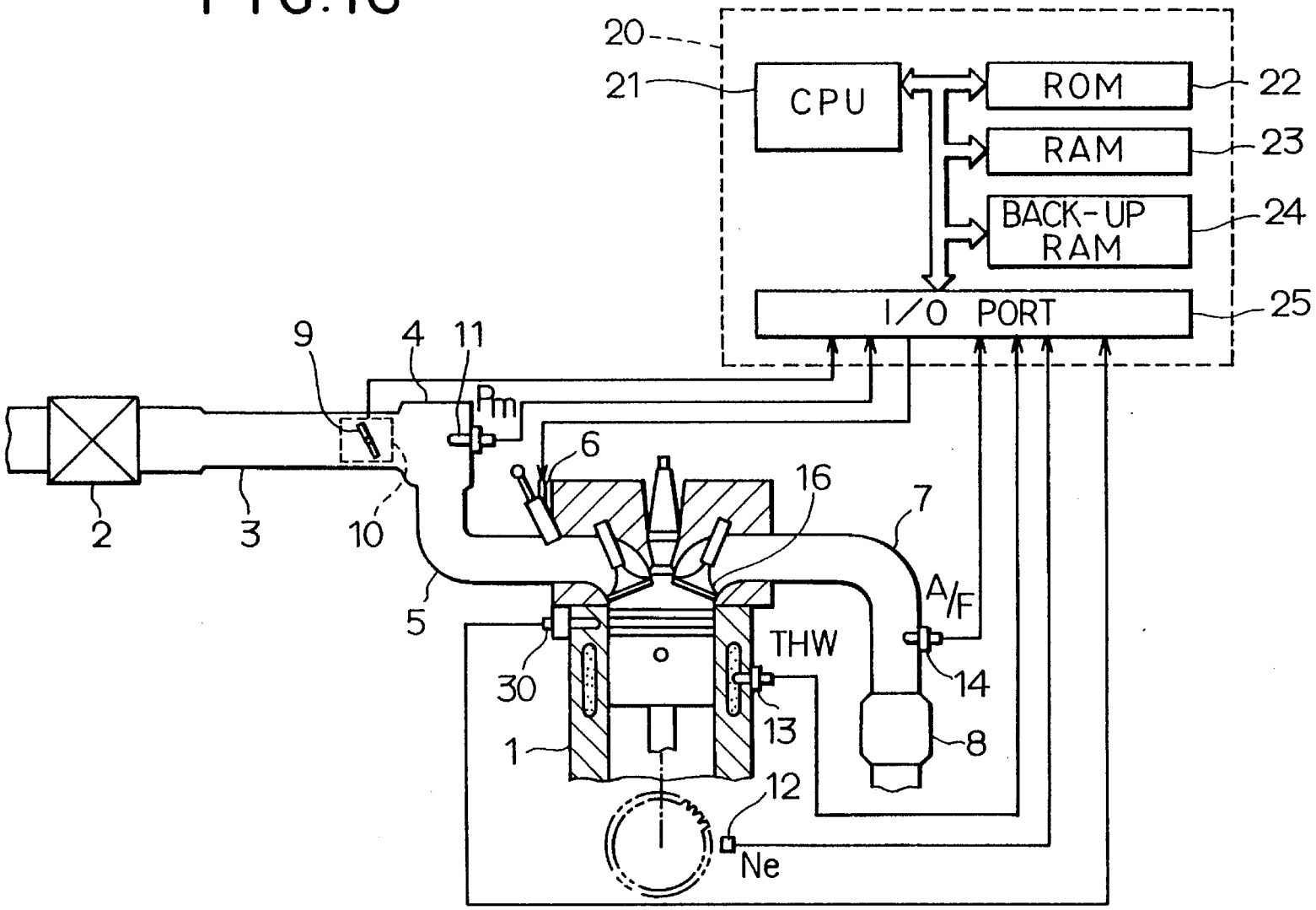
Figure 17:
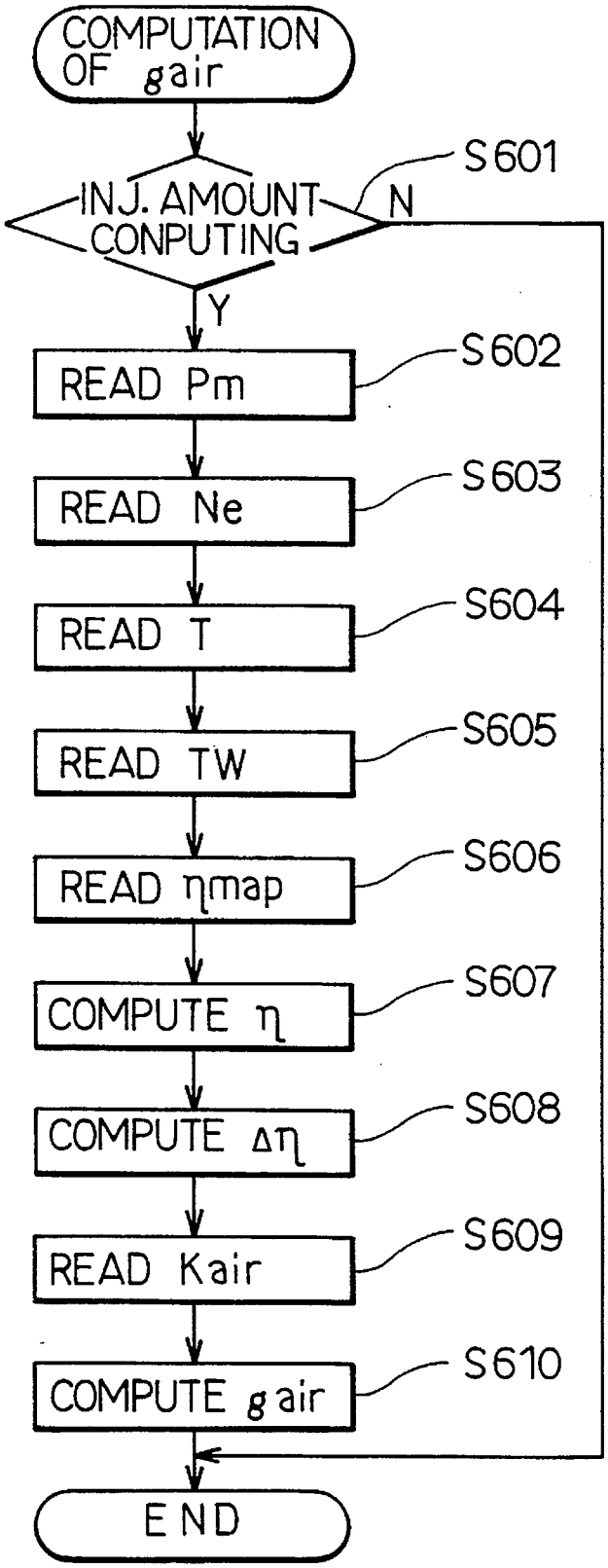

FIGS. 11(*a*) to 11(*g*) are time charts of parameters relating to fuel injection amounts at times of acceleration;

FIG. 12 is a map for obtaining water temperature correction coefficients;

FIG. 13 is a flow chart of a fuel injection amount computation routine of a fifth embodiment;

FIG. 14 is a flow chart of a fuel injection correction amount computation routine of the fifth embodiment;

FIGS. 15(*a*) to 15(*e*) are time charts showing the effect of the fifth embodiment;

FIG. 16 is a schematic diagram a control system according to a sixth embodiment of the present invention;

FIG. 17 is a flow chart of a fuel injection correction amount computation routine of the sixth embodiment; and FIG. 18 is a map for obtaining filling efficiencies.

DETAILED DESCRIPTION OF THE PREFERRED EMBODIMENTS

First Embodiment

Herebelow, a first embodiment which is specific application of the present invention will be explained with reference to FIG. 1 through FIG. 6.

1.1 Overall Basic Structure

Figure 1:
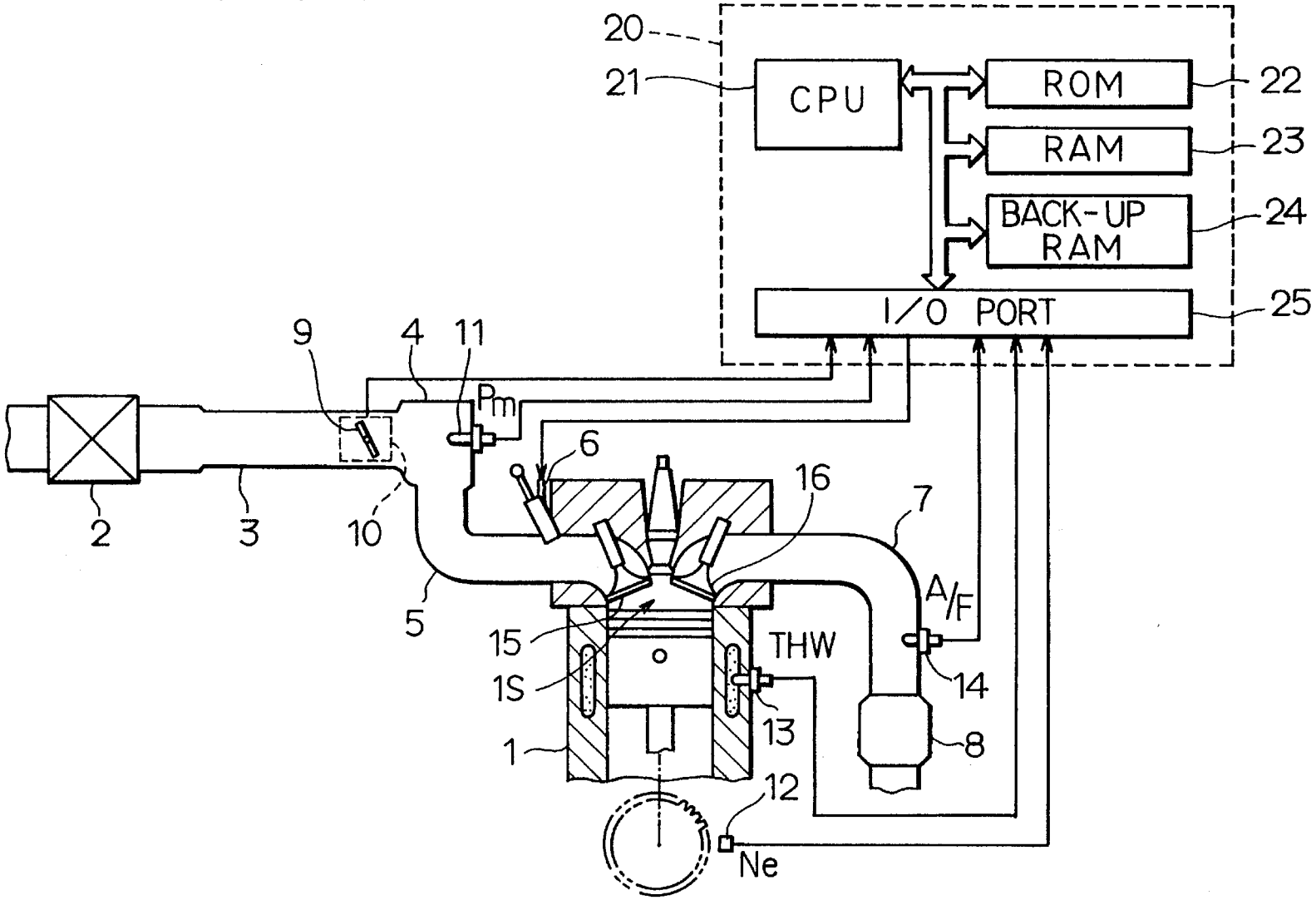
FIG. 1 is a schematic diagram of a control system according to a first embodiment of the present invention.

FIG. 1 shows the basic structure of an internal combustion engine (engine) mounted on an automobile and an electronic control apparatus thereof as an embodiment of the fuel supply amount control apparatus according to the present invention. The engine 1 of the present embodiment is assumed to be a four-cylinder four-cycle spark ignition type. The intake air of the engine 1, as shown in the figure is introduced to each cylinder 1S through an inlet or intake pipe 3 from an air cleaner 2 and via a surge tank 4 and intake manifold 5.

Meanwhile, the fuel is force fed from the fuel tank as shown in the figure and injection fuel is supplied towards the vicinity of an intake valve 15 immediately before the inlet or intake stroke of each cylinder 1S from four fuel injection valves 6 provided on the intake manifold 5 and introduced into the cylinder 1S at the intake stroke by the opening of an inlet or intake valve 15. The gas combusted inside the cylinder 1S is guided into a catalytic converter 8 through each outlet or exhaust valve 16 and exhaust pipe 7, and pollutants (CO, HC and $NO_x$) in the combusted gas are cleaned by three-way catalysts.

Also, the air introduced into the intake pipe 3 has its flow amount controlled by a throttle valve 9 engaged with an accelerator pedal. The opening degree of the throttle valve 9 is detected by a throttle opening sensor 10 and the intake pressure Pm, i.e. inner pressure in the intake pipe 3 is detected by an inlet or intake pressure sensor 11 provided in the surge tank 4.

The rotational speed Ne of the engine 1 is detected by a rotational speed sensor (crank angle sensor) 12 provided in the vicinity of a crank shaft of the engine 1. This rotational speed sensor 12 is synchronized with the crank shaft of the engine 1 and provided facing a ring gear, and output for example 24 pulse signals per two rotations (720°) of the engine 1.

Also, a water temperature THW of cooling water which fills a water jacket provided surrounding the main body of the engine 1 is detected by a water temperature sensor 13. A normal thermistor is provided as the water temperature sensor 13 and changes in the water temperature THW are detected as changes in the resistance of this thermistor.

Within the exhaust pipe 7 an air-fuel ratio sensor 14 is disposed in an upper flow portion of the catalytic converter 8 to detect the actual oxygen density of the exhaust gas in this portion and outputting this as an air-fuel ratio detection signal A/F. In this regard, where the air-fuel ratio detection signal A/F output from the air-fuel ratio sensor 14 is relevant, the actual air-fuel ratio of the air mixture supplied to the engine 1 takes a linear value.

1.2 Structure of the Electronic Control Apparatus

On the other hand, the electronic control apparatus 20 is constructed primarily by a central processing unit (CPU) 21, a read only memory (ROM) 22, a random access memory (RAM) 23, a back-up RAM 24, etc., and is connected via an input/output port (I/O port) 25 and bus for performing signal input from each of the above sensors and performing control signal output to each actuator including the injector valve 6. Also, in this electronic control apparatus 20, as well as various sensor signals for the above-described throttle opening, intake pipe internal pressure Pm, rotational speed Ne, cooling water temperature THW, air-fuel ratio A/F, etc. being input, a fuel injection amount TAU etc. is computed based-on these sensor signals, and various processes such as for controlling the drive of the fuel injection valve 6 based on the computed fuel injection amount TAU are executed.

Figure 2:
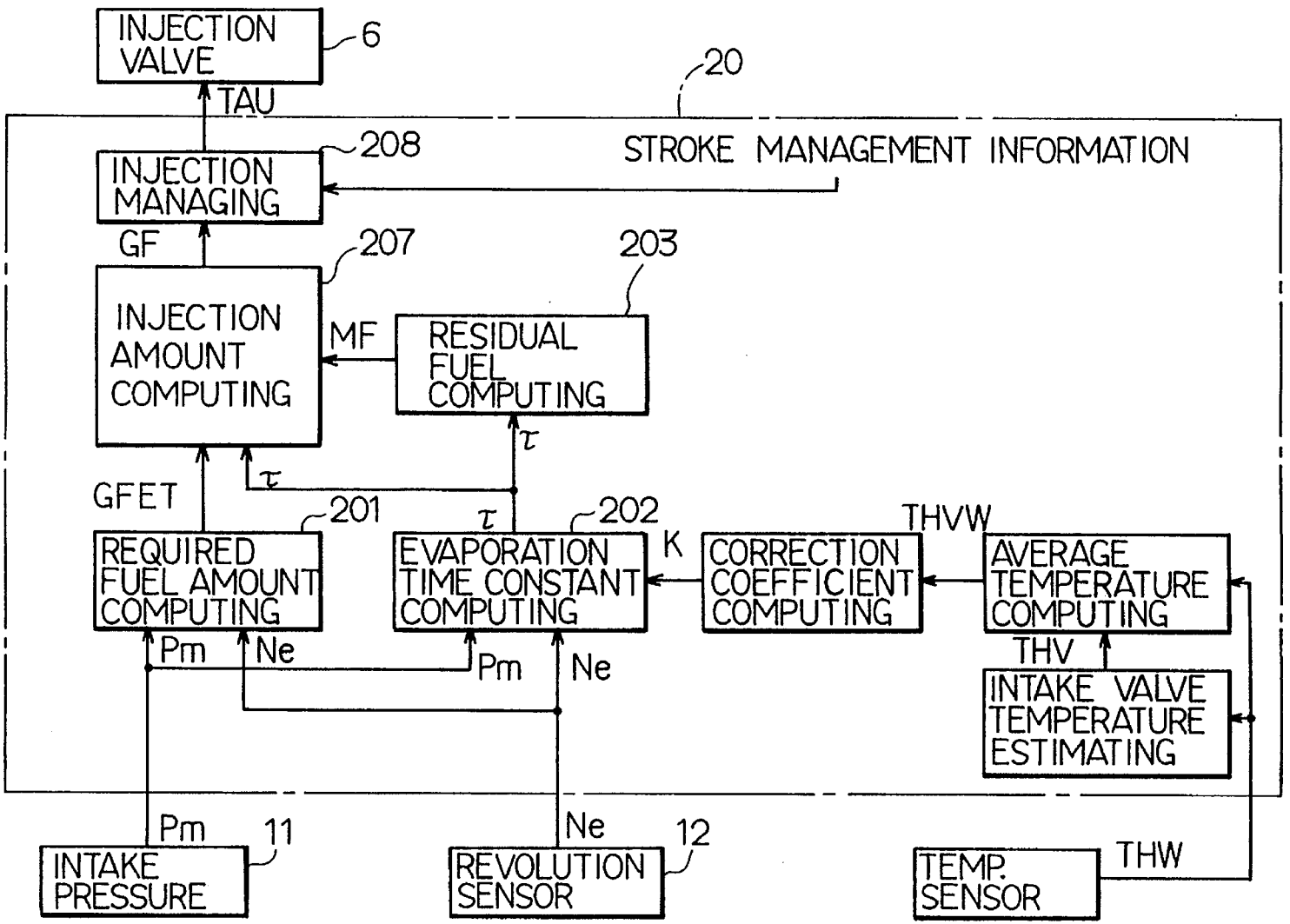
FIG. 2 is a block diagram of the functions of an electronic control apparatus of the first embodiment.
Figures 3, 4:
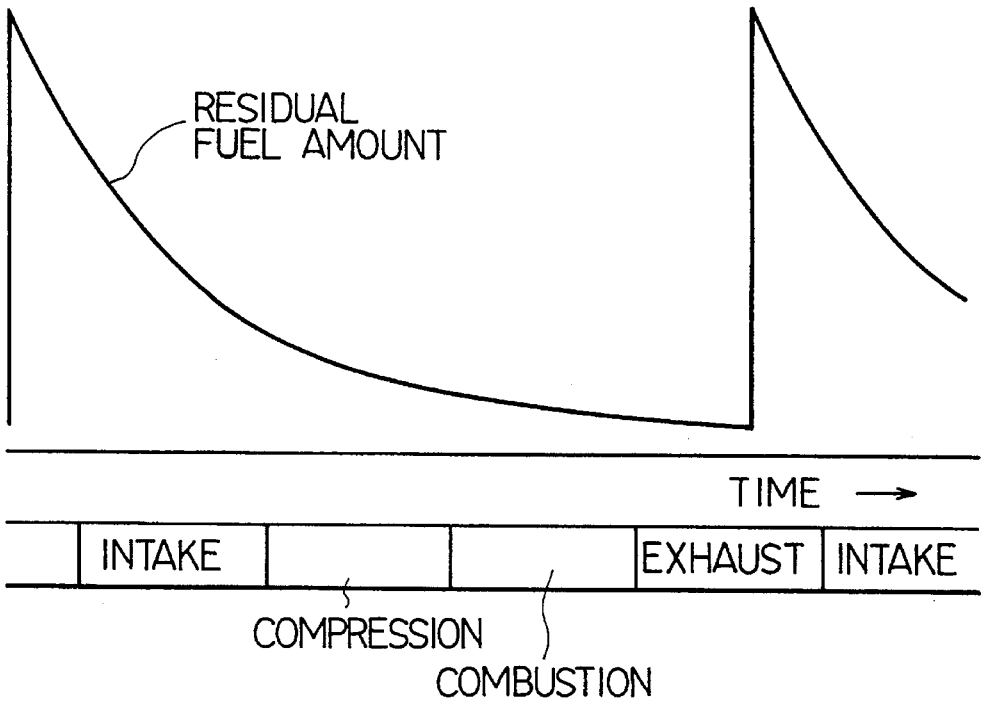
FIG. 3 is a graph showing chronological changes of a residual fuel amount in an intake system.
FIG. 4 shows one line from a conversion table showing the relationship between intake pressure and the rate of change of an evaporation time constant.

FIG. 2 shows in detail a functional structure of the electronic control apparatus 20 as a fuel supply amount control apparatus according to the present embodiment, and herebelow the structure and functions of the fuel supply amount control apparatus will be described in further detail combined with references to FIG. 2. Assuming that injection of fuel prior to the inlet or intake stroke of the engine 1 is finished, the intake valve 15 is closed during the fuel injection period and there is no entry of fuel into the cylinder 1S. Thereby, a large portion of the injected fuel adheres to the inner wall of the intake manifold 5 and the outer surface of the intake valve 15, this adhered fuel being introduced into the cylinder as fuel gas while evaporating in the space inside the intake manifold 5 during the intake stroke and also entering the cylinder in liquid form along with the air flow into the cylinder. The behavior of this residual fuel is as shown in FIG. 3, with the residual fuel amount remaining in the intake system as the ordinate and time as the abscissa.

In the apparatus of the present embodiment, (1) a required fuel amount computed from the operating conditions of the engine 1 is computed;

(2) the rate of chronological or time dependent change, i.e. evaporation time constant τ, in the fuel amount introduced into the cylinder 1S from the intake system is computed as a parameter expressing the behavior of the fuel injected into the intake system of the engine 1;

(3) as well as computing the residual fuel amount remaining in the intake system at a predetermined time based on the evaporation time constant τ, a fuel amount to be supplied to the engine 1 by injection is computed based on the residual fuel amount and the required fuel amount; and (4) the fuel injection valve 6 is controlled based on the computed fuel injection amount.

These computation processes will be explained in detail as follows. These computation processes need not be executed in the order given in this embodiment.

[I] Computation of required fuel amount

A required fuel amount computing section 201 is a section for computing a fuel amount required in the engine 1 based on intake pressure Pm detected by the air pressure sensor 11 and an engine rotational speed Ne detected by the rotational speed sensor 12 as operating conditions of the engine 1. This required fuel amount, taken as GFET can be computed as $$GFET=\text{fixed number}\bullet(Ne\bullet Pm)/(\text{theoretical air/fuel ratio}) \quad (17)$$

This obtained required fuel amount GFET is supplied to a fuel injection amount computing section 207. The required fuel amount computing section 201 can also be realized as a reference table using the ROM 22.

[II] Computation of evaporation time constant τ

The evaporation time constant τ is naturally affected by the temperature of portions to which fuel is adhered. In the present embodiment, an evaporation time constant τB is used after full heating where the engine 1 has reached a thermally steady state, and in a thermal transition period immediately after the start of operation the evaporation time constant τ corrected as in the following equation by a temperature correction coefficient k is computed.

$$\tau=(1+k)\bullet\tau B \quad (18)$$

<Evaporation time constant τB after full warm-up>

In the electronic control apparatus 20, the evaporation time constant computing section 202 computes the above evaporation time constant τB based on the intake pressure detected by the intake pressure sensor 11 and an engine rotational speed Ne detected by the rotational speed sensor 12. The following equation (19) is used to compute this evaporation time constant τB.

$$\tau B=\tau 0\bullet(Ne0/Ne)\bullet f(Pm) \quad (19)$$

(Here, Ne is internal combustion engine rotational speed at a time of computing, Pm is an intake pressure at the same time of computing, Ne0 is reference rotational speed of the internal combustion engine, Pm0 is a reference intake pressure of the internal combustion engine, τ0 is a reference evaporation time constant at reference internal combustion engine rotational speed Ne0 and a reference intake pressure Pm0, and f(Pm) is a rate of change of the evaporation time constant τB with respect to the intake pressure Pm with the evaporation time constant τB at the reference intake pressure Pm0 as a reference.)

For example, the rotational speed Ne0 taken as a reference is 1,000 rpm, the intake pressure Pm0 similarly taken as a reference is 290 mmHg, and the evaporation time constant τ0 at that time is 65.3 ms, while on the other hand where the rate of change f(Pm) of the evaporation time constant τB with respect to the intake pressure Pm is set as in the table shown in FIG. 4, in the evaporation time constant computing section 202 the evaporation time constant τB is obtained in the following state:

(1) the table of FIG. 4 is searched by the intake pressure Pm detected by the intake pressure sensor 11 to obtain the rate of change f(Pm) of the evaporation time constant τ corresponding thereto;

(2) the ratio (Ne0/Ne) of the reference rotational speed Ne0 and the rotational speed Ne detected by the rotational speed sensor 12 is obtained; and (3) the evaporation time constant τ0 under the thus obtained rate of change f(Pm) of the evaporation time constant τB, rotational speed ratio (Ne0/Ne) and operating conditions taken as references above is multiplied.

The table shown in FIG. 4 may also be realized as a reference table using the ROM 22 and values not shown in the table are suitably correction-computed.

<Computation of temperature correction coefficient k>

In the present embodiment, an average temperature THVW of the fuel adhesion portions is obtained and the temperature correction coefficient k of the evaporation time constant τB after full warm-up is obtained based on this average temperature THVW. The procedure thereof will be explained with reference to the block diagram of FIG. 2 and the flow chart of FIG. 5.

The injected fuel is scattered and adheres to the inner wall surface of the intake manifold 5 and the outer surface of the intake valve 15. Consequently, in computing the average temperature THVW of fuel adhering portions, a percentage k3 of the injected fuel amount may be considered, and the inner wall surface temperature of the intake manifold and the temperature of the intake valve 15 may be sum averaged based on this percentage (adhesion rate k3). In other words, since the temperature of the intake manifold can be substituted for the cooling water temperature THW, taking the intake valve temperature as THV, the following equation is reached.

$$THVW=K3\bullet THV+(1-K3)\bullet THW \quad (20)$$

The adhesion ratio k3 is affected by the size of the intake valve 15, the fuel injection timing, etc. as well as the attachment position and injection direction of the fuel injection valve 6, and in this embodiment it is a fixed value set according to the specifications of the engine 1.

Although the temperature THV of the intake valve 15 is the same temperature as the cooling water temperature THW immediately after the start of engine operation, after the start of operation it increases in a first-order lag according to an accumulation value of combustion energy for each combustion of the fuel. Here, the combustion energy may be expressed by a cumulative value of the fuel amount injected after the start of operation. Consequently, if the cumulative value of the injected fuel is taken as "accumtp", the estimated value of the intake valve temperature THV can be computed by the following equation.

$$THV=THVo+(THVmax-THVe)\bullet\{1-e^{-k2\bullet accumtp}\} \quad (21)$$

In the above equation, THV0 is the intake valve temperature at the start of engine operation, THVmax is the maximum value of the intake valve temperature, for example 125°, and k2 is a parameter for converting combustion energy to temperature increase and is a value inherent to the engine. If the intake valve temperature THV and subsequently the average temperature THVW of the fuel adhesion portions can be obtained in this way, since the temperature correction coefficient k is the function of the average temperature THVW, the temperature correction coefficient k can be applied by means of the reference table, taking the average temperature THVW for example as a parameter.

Figure 5:
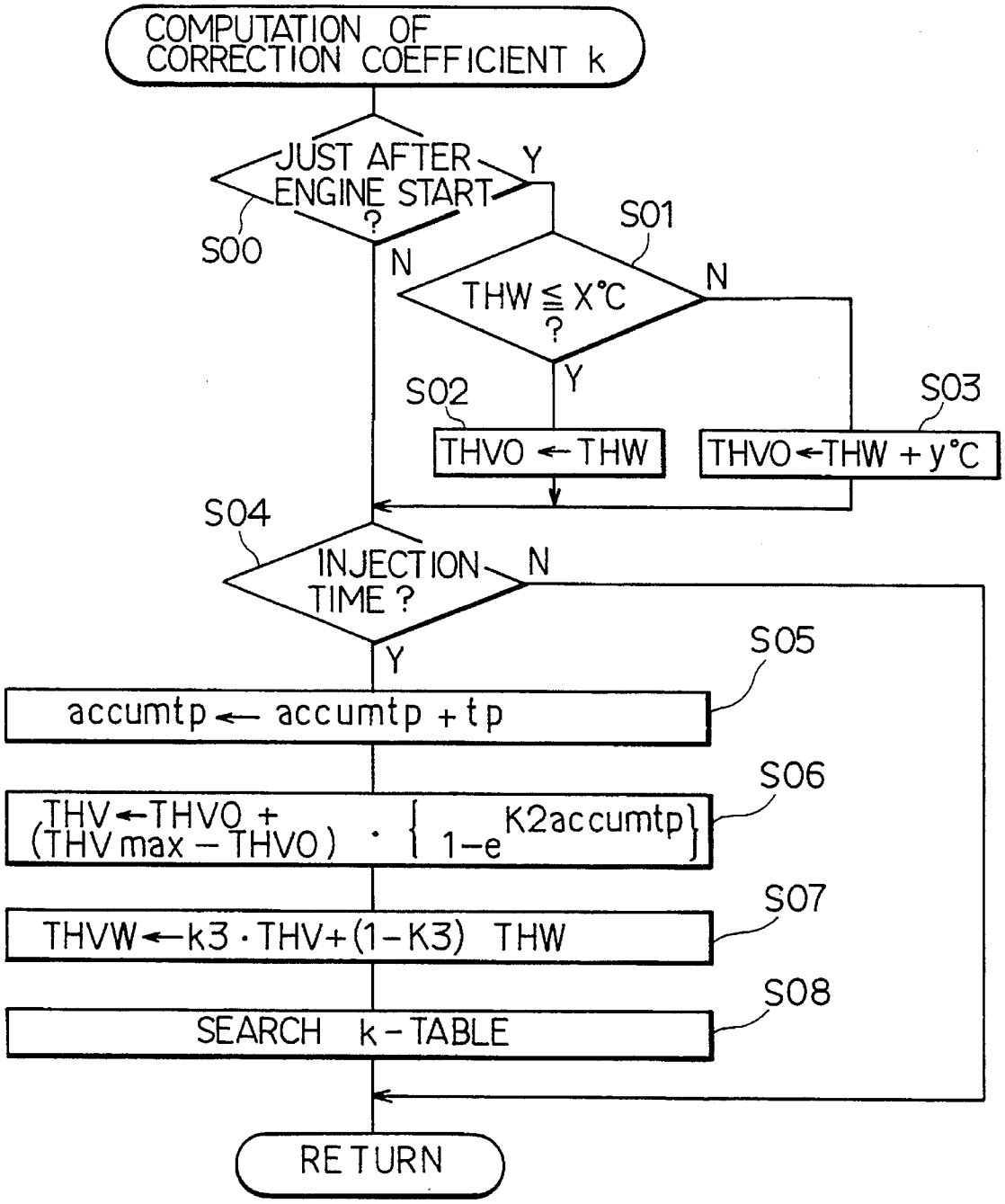
FIG. 5 is a flow chart of a computation routine for a temperature correction coefficient of the first embodiment.

In the present embodiment, as shown in FIG. 5, upon start of a computation routine for the temperature correction coefficient k, firstly it is judged whether or not it is immediately after the start of operation of the engine 1 (step S00), and where it is immediately after the start of operation it is further judged whether the cooling water temperature THW is below x° C. (e.g. 50° C.) or not (step S01). Even if immediately after the start of operation of the engine 1, because after start of operation ("Y" in step S01) where the engine 1 has been left for a long time and has cooled and restart of operation where the engine is still in a high temperature state ("N" in step S01) are distinguished, in the case of the former it can be seen if the intake valve temperature THV0 is equivalent to the cooling water temperature THW, while in the case of the latter it can be seen whether the intake valve temperature THV0 is only y° C. higher than the cooling water temperature THW (e.g. y=30), so that the initial value of the intake valve temperature is set as THV0 in each of steps S02 and S03. The above "y" may be set so that the intake valve temperature THV is the maximum value THVmax thereof when the cooling water temperature THW is the water temperature when fully heated (e.g. 80° C.).

Also, the computations after step S05 are executed at the fuel injection time. In other words, the previous injected fuel amount tp is added to the cumulative value accumtp of the injected fuel (step S05), and the estimated value THV of the intake valve at that time is computed using the above equation (21) (step S06). Then in step S07 an accumulated average is computed form the intake valve temperature THV and intake manifold temperature (cooling water temperature THW) in consideration of the adherence rate k3, and the temperature correction coefficient k is searched from the reference table based on the average temperature THVW (step S08). This reference table is stored in the ROM 22, and values not in this table can be suitably interpolation-computed.

<Computation of the evaporation time constant τ>

Since the evaporation time constant τB after full warm-up and the temperature correction coefficient k at that time are computed as above, the evaporation time constant computing section 202 computes an evaporation time constant τ at that time based on the above equation (18). Since this evaporation time constant τ is computed in consideration of the rate (adhesion rate k3) of to what portions of the intake system the injected fuel is adhered and the temperature at each portion when the fuel is injected, as already described, even at a time immediately after the start of operation while the intake valve temperature THV is changing, the evaporation time constant τ can be correction computed according to the situation.

[III] Computation of the injected fuel amount

As described above the obtained evaporation time constant τ is supplied to each of the residual fuel amount computing section 203 and the fuel injection amount computing section 207. The residual fuel amount computing section 203 computes the fuel amount remaining in the intake system based on the evaporation time constant τ and the previous fuel injection amount GF to be described later, and the fuel injection amount computing section 207 computes a fuel amount to be injected at the fuel injection time. The fuel amount remaining in the intake system is supplied, by way of the following C. F. Aquino equation, as $$MF(t)=(1-\Delta t/\tau)\bullet MF(t-\Delta t)+x\bullet GF(t)\bullet\Delta t=(1\Delta t/\tau)\bullet MF(t-\Delta t)+GF(t)\bullet\Delta t \quad (22)$$

In this equation (22), Δt indicates a sampling cycle (computation cycle) of the apparatus of the present embodiment, and herein is a time period corresponding to a 60° crank angle, a time period shorter than the fuel injection period for each cylinder. Also, GF(t) indicates a fuel injection amount per unit time period and GF indicates a fuel injection amount during one stroke. Further, x is a rate at which the injected fuel adheres to the inner wall surface of the intake system, i.e. adherence rate, and in this embodiment for the sake of simplicity is determined as 1.

Also, In the same equation (22), MF(t−Δt) means the residual fuel amount MF computed one time previously. Here, in this electronic control apparatus 20, this residual fuel amount MF computed through the residual fuel amount computing section 203 is temporarily stored in an auxiliary memory and at the time of the next computation this stored residual fuel amount Mf is read out as the "previous residual fuel amount MF(t−Δt)" and supplied to the residual fuel amount computing section 203. The first right-hand portion $$1-\Delta t/\tau \quad (23)$$

of the above equation (22), based on the condition Δt<<τ, is an equation resembling $$e^{-\Delta t/\tau} \quad (24)$$

of the equation (1). Consequently, when attempting to compute an accurate residual fuel amount using the equation (22) shortening the sampling time Δt as much as possible is preferred. However, shortening the sampling time Δt and frequently computing the residual fuel amount MF and the fuel injection amount GF means that the computational load in the electronic control apparatus 20 increases and frequently computing the fuel injection amount GF outside the fuel injection times results in waste. In the present embodiment the Aquino operator α of the next equation is used to rationalize this point. This will be explained below.

$$\alpha=(1-\Delta t/\tau) \quad (25)$$

In other words, in the equation (22) resembling the Aquino equation, re-expressing the right side using the residual fuel amount MF(t−nΔt) of the previous stroke, the next equation is obtained. Here, GF(t) is the fuel amount injected in one stroke period.

$$MF(t)=\alpha(t)\bullet\alpha(t-\Delta t)\bullet\alpha(t-2\Delta t)\bullet MF(t-n\Delta t)+GF(t) \quad (26)$$

Expressing this using one stroke period, i.e. the period i from the previous fuel injection to the current injection of fuel, the next equation is obtained.

$$MF(i)=A\alpha(i)\bullet MF(i-1)+GF(i) \quad (27)$$

Here, Aα(i) is defined in the next equation, and is one-stroke multiplied by successively multiplying the Aquino operators computed for each sampling.

$$A\alpha(i)=\alpha(t)\bullet\alpha(t-\Delta t)\bullet\alpha(t-2\Delta t)\bullet\ldots\alpha(t-n\Delta t) \quad (28)$$

Also, since the fuel amount actually supplied to the cylinder during one stroke corresponds to a value of the previous residual fuel amount MF(i−1) added to the fuel injection amount at a given time GF(i) with the residual fuel amount at that time MF(i) subtracted therefrom, if this is made GFe(i), it is supplied as $$\begin{aligned} GFe(i) &= GF(i) - \{MF(i) - MF(i-1)\} \\ &= GF(i) - \{A\alpha(i) \cdot MF(i-1) + GF(i) - MF(i-1)\} \\ &= (1 - A\alpha(i)) \cdot MF(i-1) \end{aligned} \tag{29}$$

Here, if MF(i−1) and MF(i) are obtained from this equation (29) and an erasure operation of the residual fuel amount MF by substituting these in the equation (27) is performed, the next equation is obtained.

$$GFe(i+1) = \{1 - A\alpha(i+1)/1 - A\alpha(i)\} \bullet GFe(i) + [(1 - A\alpha(i+1)] \bullet GF(i) \tag{30}$$

Since computing the fuel amount to be injected determines GF(i) so that the right side of this equation (30) becomes the required fuel amount GFET(i+1), this becomes $$\begin{aligned} GF(i) &= \frac{1}{1 - A\alpha(i+1)} \cdot \left[ GFET(i+1) + A\alpha(i) \frac{1 - A\alpha(i+1)}{1 - A\alpha(i)} \cdot GFe(i) \right] \\ &= \frac{GFET(i+1)}{1 - A\alpha(i+1)} - \frac{A\alpha(i)}{1 - A\alpha(i)} \cdot GFe(i) \end{aligned} \tag{31}$$

and substituting GFe(i) in equation (29), this becomes $$GF(i) = \frac{GFET(i+1)}{1 - A\alpha(i+1)} - \frac{A\alpha(i)}{1 - A\alpha(i)} \cdot (1 - A\alpha(i)) \cdot MF(i-1) \tag{32}$$

Here, substituting the current information GFET(i) and Aα(i) for the future information GFET(i+1) and Aα(i+1), the next equation is obtained, the injected fuel amount GF(i) being able to be expressed by the stroke period Aquino operator Aα(i), the required fuel amount GFET(i) and the previous residual fuel amount MF(i−1).

$$GF(i) = \frac{GFET(i)}{1 - A\alpha(i)} - A\alpha(i) \cdot MF(i-1) \tag{33}$$

Figure 6:
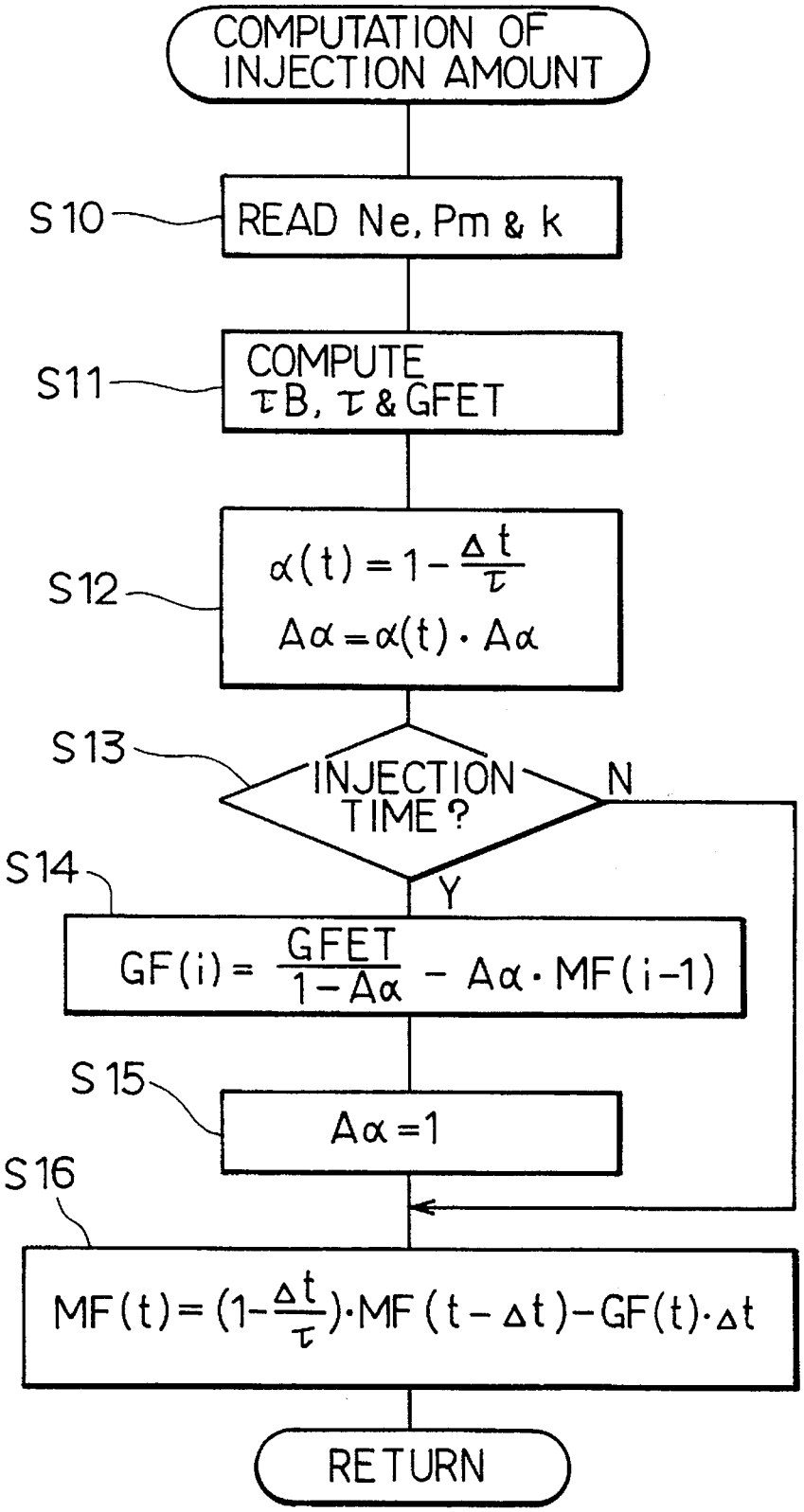
FIG. 6 is a flow chart of a fuel injection amount computation routine of the first embodiment.

Consequently, in this embodiment, for every advance of the crank angle of 60°, the fuel injection amount computation routine shown in the flow chart of FIG. 6 is executed, firstly reading out the intake pressure Pm, the rotational speed Ne and the temperature correction coefficient k (step S10), at which time the evaporation time constant τB after full warm-up, the evaporation time constant τ and the required fuel amount GFET are computed based on these values as described above (step S11) and further the Aquino operator α(t) and the stroke period Aquino operator Aα are computed (step S12). Here, because Δt is a sampling period, it corresponds to the crank angle of 60° and the stroke period Aquino operator Aα is a value of the Aquino operator α(t) at that time multiplied by the previously calculated stroke period Aquino operator Aα. Then, if this time is not a fuel injection period or time ("N" in step S13), computation of the injected fuel amount GF(i) is skipped, the residual fuel amount MF(t) at that time is computed and the routine returns (step S16).

Thereafter, the crank angle advances another 60°, whereupon since the fuel injection amount computation routine is executed again, as described above the Aquino operator α(t) and the stroke period Aquino operator Aα are computed and if it is a fuel injection time ("Y" in step S13) the fuel injection amount GF(i) is computed based on the above equation (33) and the stroke period Aquino operator Aα returns to 1 (steps S14 and S15). In other words, in the present embodiment the stroke period Aquino operator Aα is computed for each sampling period (each 60° crank angle), and based thereon the fuel injection amount (GF(i) only at the fuel injection time is computed. Although computation of the stroke period Aquino operator Aα corresponds to preparatory computation for computing the fuel injection amount GF, it differs from computation of the fuel injection amount GF itself, having a very small computational load.

Upon the fuel injection amount GF being computed in the fuel injection amount computing section 207 in the fuel injection time, the electronic control apparatus 20 multiplies the fuel injection amount GF obtained in the injection management section 208 by a predetermined unit conversion coefficient, and applies this as an operation amount TAU of the fuel injection valve 6 to the fuel injection valve 6 via the input/output port 25 to execute fuel injection.

1.3 Effect of the first embodiment (1) Conventionally, because the evaporation time constant τ was experimentally determined and a two-dimensional map of various conditions produced, there was the problem that a great deal of labor was required for the production and correction thereof, but in this embodiment, since the evaporation time constant τ is obtained by computation, man-hours for producing and correcting a large two-dimensional map are unnecessary and economization of developmental time and developmental expenses is possible.

(2) In addition, since computation for computing the evaporation time constant τ and the fuel injection amount based thereon (steps S11, S12 and S16 in FIG. 6) is executed in a shorter time period (here the 60° crank angle) than the interval between two successive fuel injections, even in a transitional period of rapid changes in operating conditions such as during acceleration, deceleration, etc., the residual fuel amount remaining in the intake system can be accurately known, an appropriate fuel injection amount can subsequently be computed, and controllability at times of acceleration and deceleration can be improved. Also, while such accurate computation is possible, since a computation for computing the fuel injection amount by a simple calculation using the Aquino operator α and the stroke period Aquino operator Aα can be executed, the computational load in the electronic control apparatus 20 can be reduced and accurate computation and high-speed processing can be made compatible.

(3) Also, in the present embodiment, in consideration of an adherence rate of fuel injected from the fuel injection valve 6 to the intake manifold 5 and intake valve 15, an average temperature THVW of the fuel adherence portions is computed by weighted average computation of temperatures at each portion according to the adherence rate, and the evaporation time constant τ is obtained by correction of the evaporation time constant τB after full warm-up based on this computed average temperature THVW. As a result, even immediately after the start of operation of the engine 1, an appropriate evaporation time constant τ can be computed and accurate fuel injection can be performed even immediately after the start of operation.

(4) Further, when measuring the temperature of the intake valve 15, since an estimated value is computed based on a cumulative value of the injected fuel from the viewpoint that the temperature thereof increases by a first-order lag according to a cumulative value of combustion energy in the internal combustion engine, direct temperature measuring means such as a temperature sensor is unnecessary.

Second Embodiment

The computation method for the fuel injection amount GF(i) differs from the above first embodiment, and this is an example of an application of a pole assignment method to this computation. The following conditional feedback will be considered in the above equation (30).

$$GF(i)=K\bullet GFe(i)+a \tag{34}$$

At this time, equation (31) becomes the equation (35).

$$\begin{aligned} GFe(i+1) &= \alpha i\cdot\frac{1-\alpha(i+1)}{1-\alpha(i)}\cdot GFe(i)+ \\ &\quad (1-\alpha(i+1))\cdot\{K\cdot GFe(i)+a\} \\ &= \left\{\frac{\alpha(i)\cdot(1-\alpha(i+1))}{1-\alpha(i)}+\right. \\ &\quad \left.(1-\alpha(i+1))\cdot K\right\}\cdot \\ &\quad GFe(i)+(1-\alpha(i+1))\cdot a \end{aligned} \tag{35}$$

K is set so that the pole of this system:

$$\frac{\alpha(i)\cdot(1-\alpha(i+1))}{1-\alpha(i)}+(1-\alpha(i+1))\cdot K \tag{36}$$

becomes a set value Z1. In other words, the following:

$$K=\frac{Z1}{1-\alpha(i+1)}-\frac{\alpha(i)}{1-\alpha(i)} \tag{37}$$

Also, since at that time $$GFe(i+1)=Z1\bullet GFe(i)+(1-\alpha(i+1)) \tag{38}$$

it becomes as follows.

$$\begin{aligned} \lim_{i\to\infty} GFe(i) &= \lim_{Z\to 1}\frac{(1-\alpha(i+1))\cdot a}{Z-Z1} \\ &= \{1-\alpha(i+1)\}/(1-Z1) \end{aligned} \tag{39}$$

Consequently, the parameter a is set so that this convergent value is a required value. In other words, the following:

$$a=GFET(i)\bullet(1-Z1)/(1-\alpha(i+1)) \tag{40}$$

At this time, equation (34) becomes the equation (41):

$$\begin{aligned} Gf(i) &= \left(\frac{Z1}{1-\alpha(i+1)}\right)-\left(\frac{\alpha(i)}{1-\alpha(i)}\right)\cdot Gfe(i)+ \\ &\quad \frac{GFET(i)}{1-\alpha(i+1)}\cdot(1-Z1) \\ &= \left(\frac{Z1}{1-\alpha(i+1)}-\frac{\alpha(i)}{1-\alpha(i)}\right)\cdot(1-\alpha(i))\cdot \\ &\quad MF(i-1)+\frac{GFET(i)}{1-\alpha(i+1)}\cdot(1-Z1) \\ &= \frac{GFET(i)}{1-\alpha(i+1)}\cdot(1-Z1)+ \\ &\quad \frac{Z\cdot(1-\alpha(i))-\alpha(i)\cdot(1-\alpha(i+1))}{1-\alpha(i+1)}\cdot MF(i-1) \end{aligned} \tag{41}$$

Here, approximating α(i+1)=α(i), this becomes:

$$Gf(i)=\frac{GFET(i)}{1-\alpha(i)}\cdot(1-Z1)-(\alpha(i)-Z1)\cdot MF(i-1) \tag{42}$$

Figure 7:
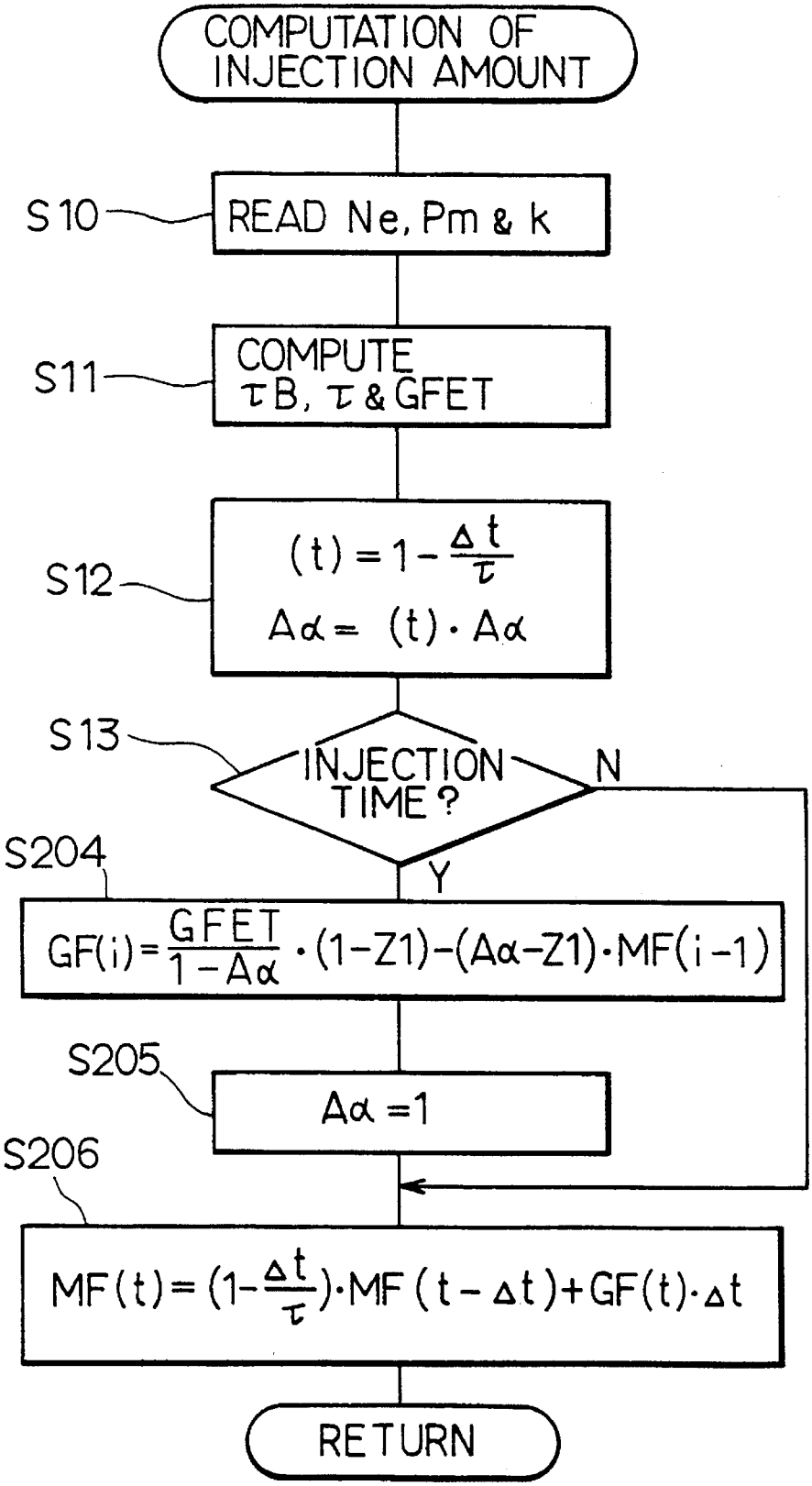
FIG. 7 is a flow chart of a fuel injection amount computation routine of a second embodiment.

Here, in this embodiment, subsequent to steps S10 to S13, the fuel injection amount GF is computed using the above equation (42) in the fuel injection amount computation routine as shown in step S204 in FIG. 7. Upon computing the fuel injection amount GF by computation by means of this type of pole assignment method, a suitable amount of fuel can be injected even where restricted by the capacity of the fuel injection valve. In other words, for example, where the cooling water temperature at a time of low air temperature is low, since there is the situation that fuel adhering to the intake system evaporates with difficulty, upon a sudden acceleration operation at that time, it is necessary to inject a large amount of fuel. However, since there is a fixed limit to the amount of fuel the fuel injection valve is able to inject per unit of time due to the size thereof etc., a situation where the required fuel amount cannot be injected due to the operating conditions arises. With respect to this, according to the present embodiment, the increased amount of necessary fuel is dividedly injected separated into a number of times, so that even if the fuel injection valve is not a large type with sufficient surplus, the advantage that suitable fuel injection can be performed even in cases of sudden acceleration at low temperatures can be achieved. Portions of this second embodiment other than those especially described above are similar to those of the first embodiment and repeated explanation thereof is omitted for brevity.

Third Embodiment

Figure 8:
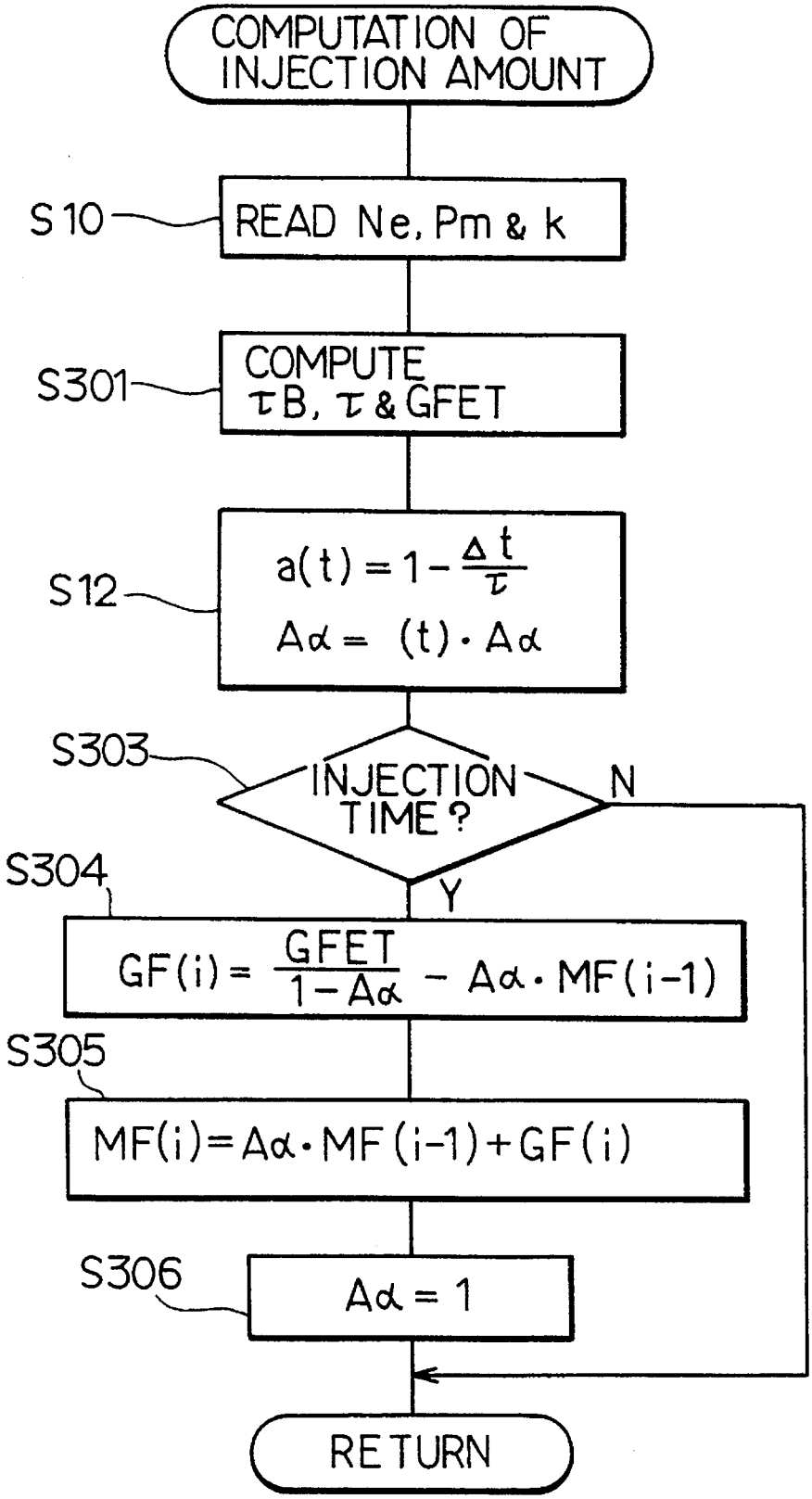
FIG. 8 is a flow chart of a fuel injection amount computation routine of a third embodiment.

What differs from the first embodiment resides in that the residual fuel amount MF(t) is computed only at the fuel injection period in the fuel injection amount computation routine. In other words, as shown in the flow chart of FIG. 8, although computation of the Aquino operator α and the stroke period Aquino operator Aα is executed per each sampling of the crank angle of 60°(step S301), where this sampling period is not judged to be a fuel intake time in step S303, computation of both the fuel injection amount GF and the residual fuel amount MF (steps S304 and S305) is skipped and the routine immediately returns, so that computations of the fuel injection GF and residual fuel amount MF are only executed at fuel injection times.

According to such a structure, since the computation load can be made one level lighter, the advantage that suitability of controllability and high-speed processing can be made compatible by reducing the computing load can be achieved, similarly to the first embodiment. Even in cases where the fuel injection amount GF(i) is computed based on the pole assignment method as in the second embodiment, naturally computation of the residual fuel amount MF(t) may be executed only at the fuel injection time as in the third embodiment. Also with regard to the third embodiment, portions other than those especially described above are similar to those of the first embodiment and repeated explanation thereof is omitted.

Fourth Embodiment

Figure 9:
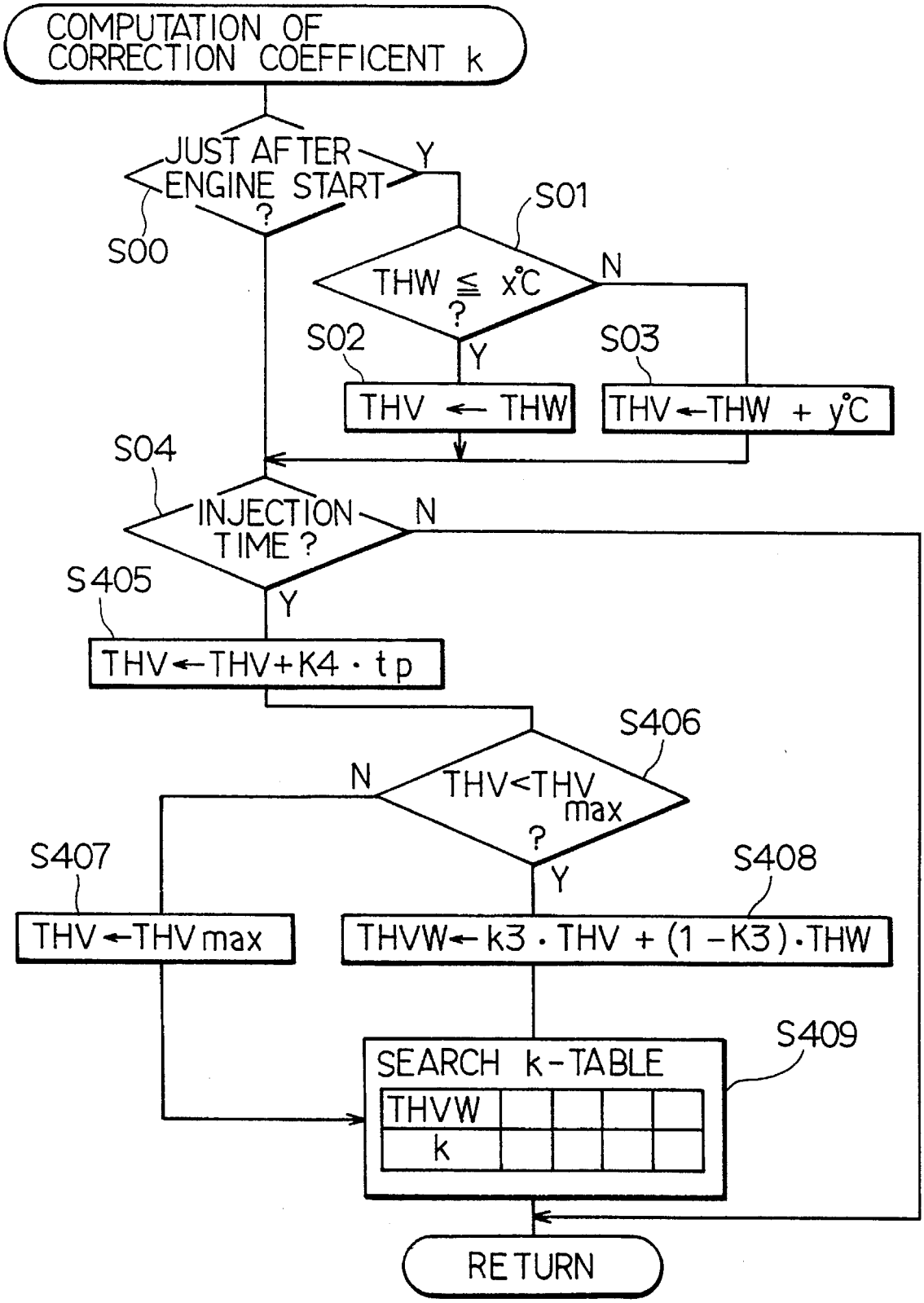
FIG. 9 is a flow chart of a computation routine for a temperature correction coefficient of a fourth embodiment.

The fourth embodiment, because "power multiplication" of e (step S06 of FIG. 5) is difficult according to conditions such as the computing capacity of the computer etc. in the computing routine of the temperature correction coefficient k in the first embodiment, deals with this problem. In other words, in step S405 in the flow chart of FIG. 9, a temperature increase portion (k4●tp) according to the combustion energy is added to the current intake valve temperature THV in place of the injection amount tp. When this is done, an estimated temperature of the intake valve 15 can be computed by a simple addition calculation. In this case it is necessary to execute steps S406 and S407 so that this estimated temperature THV does not exceed the maximum value THVmax of the intake valve temperature. Also in this fourth embodiment, portions other than those especially described above are similar to those of the first embodiment and repeated explanation thereof is omitted.

Fifth Embodiment

Figure 10:
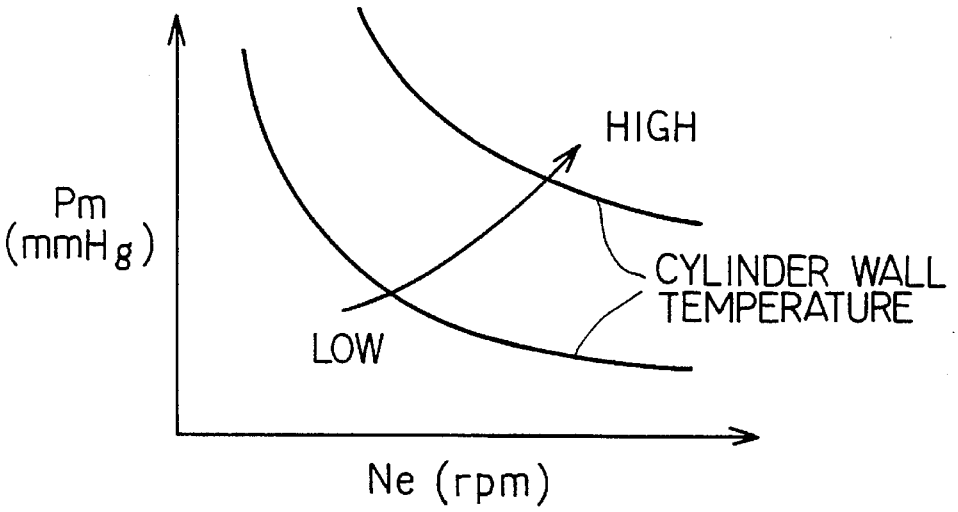
FIG. 10 is a characteristic graph of the inside wall temperature of a cylinder.

The fifth embodiment, with regard to the fuel injection amount computed in the first embodiment, performs a further correction with respect to changes in mixture charging efficiency at times of acceleration/deceleration. Upon changes in the load (hereafter explained by citing the example of intake pressure Pm) and engine rotational speed Ne when acceleration/deceleration is performed, the cylinder inner wall temperature changes according to the characteristic as shown in FIG. 10. However, this cylinder inner wall temperature Tsw changes late as shown in FIG. 11(*b*) with respect to changes in the load (intake pipe internal pressure Pm) shown in FIG. 11(*a*), and together with this intake temperature T within the cylinder changes late with respect to changes in the intake pipe internal pressure Pm as shown in FIG. 11(*c*). The charging efficiency η of air introduced into the cylinder is obtained from the equation $$\eta \propto (Pm/T) \bullet f(\epsilon) \tag{43}$$

(where ϵ is compression rate), therefore when the cylinder internal temperature T changes late, the charging efficiency η of air introduced into the cylinder also changes until the cylinder inner temperature T stabilizes (FIG. 11(*d*)).

The required fuel amount GFET of the fuel amount actually injected from the injector can be obtained from the map previously stored in the ROM 22, according to the operating conditions of the engine (in the present embodiment the intake pressure Pm and engine rotational speed Ne). This map for obtaining the required fuel amount GFET is produced as one which changes without delay as in the charging efficiency η as shown by the chain-and-dot line in FIG. 11(*d*) when the intake pressure Pm changes. However, in actuality the charging efficiency η with respect to changes in the intake pressure Pm changes late as shown by the solid line in FIG. 11(*d*). As a result, a disparity or difference Δη between the charging efficiency η on the map and the actual charging efficiency η occurs as shown in FIG. 11(*e*). Together with this, naturally a disparity amount ΔQ in the introduced air amount Q determined by the filling efficiency occurs (FIG. 11(*f*)) and the air-fuel rate thereof is disturbed (FIG. 11(*g*)). In FIG. 11(*f*) the solid line indicates the actually introduced air amount and the chain-and-dot line indicates the mapped introduced air amount.

For example, because at a time of acceleration the actual charging efficiency η is greater than the mapped filling efficiency ηmap, the introduced air amount Q is large with respect to the required fuel amount GFET shown by the inclined line in FIG. 11(*f*) and the air-fuel ratio becomes lean. Thereby, the fuel amount corresponding to the disparity ΔQ of air amount during acceleration/deceleration must be corrected with respect to the required fuel amount GFET. Next, a principal for obtaining a fuel injection correction amount gair (as is) with respect to this disparity amount ΔQ of the air amount will be explained.

The disparity amount ΔQ of the introduced air amount is determined by the disparity amount Δη of the charging efficiency and the disparity amount Δη of the charging efficiency occurs due to the cylinder internal temperature T changing by a first-order lag with respect to an increase in the intake pipe pressure Pm. Thereby, in order to obtain the disparity amount Δη of the charging efficiency a disparity amount ΔT between the actual temperature of the cylinder internal temperature and the mapped temperature may be obtained.

Since the increase delay of the cylinder internal temperature T occurs due to change in the intake pipe pressure Pm, the disparity amount ΔT of the cylinder internal temperature can be obtained from the amount of change dPm of the intake pressure. Because the cylinder internal temperature T changes with a first-order lag from the intake pressure Pm the disparity amount ΔT of the cylinder internal temperature can be obtained from the first-order lag amount dPmn of the intake pressure change amount.

The first-order lag amount dPmn of the intake pressure change amount can be expressed by $$dPmn=\{(a-1)dPmn0+dPmn\}/a \tag{44}$$

Here the constant a is a value determined form an A/F tailing time (time by which the air-fuel ratio is displaced) shown in FIG. 11(*g*) as $T_c$, specifically, it is a value previously determined by conformity such that, taking the time from which the intake pressure Pm changes as a $T_c$ lapse, the first-order lag amount dPmn of the intake pressure change amount is 0. From the above the disparity amount Δη of the charging efficiency can be obtained from the first-order lag amount dPmn of the intake pressure change amount (Δη∝dPmn). Further, the introduced air amount disparity amount ΔQ can be obtained from the disparity amount Δη of the charging efficiency (Δη∝ΔQ), and finally the fuel injection correction amount gair can be obtained (ΔQ∝gair).

Now, taking a conversion constant for converting the first-order lag amount dPmn of the intake pressure amount corresponding to the introduced air amount disparity amount ΔQ to the fuel injection amount as kh, the fuel injection correction amount gair can be obtained from $$gair=kh \bullet dPmn \tag{45}$$

Further, because the A/F tailing time $T_c$ is as large as during warm-up, a correction is added by the cooling water temperature TW.

$$gair=kh \bullet dPmn \bullet (1+kair) \tag{46}$$

Here, kair is a constant set according to the cooling water temperature TW, and is a large value to the extent that the cooling water temperature TW is low as shown in FIG. 12.

An example of the above acceleration/deceleration correction applied to the first embodiment will be explained. FIG. 13 is a fuel injection amount computation routine and corresponds to FIG. 6 of the first embodiment. Hereunder, the present example will be explained according to this flow chart. The same step numbers as those in FIG. 6 will be attached to the steps for performing the same processes as in FIG. 6 (steps other than step S140) and explanation thereof omitted. That is, the difference with the first embodiment is only the part where a process for adding the fuel injection correction amount gair when the fuel injection amount GF(i) is obtained is executed. In step S140, the equation for computing the fuel injection amount is as below.

$$GF(i)=GFET/(1-A\alpha)-A\alpha \bullet MF(i-1)+gair \tag{47}$$

Next, the process for computing the fuel injection correction amount gair will be explained based on the flow chart shown in FIG. 14 (corresponding to the fuel injection amount correcting means). This flow chart is executed at a time allocation per each predetermined time period.

Once the fuel injection correction amount gair computation process is executed, it is judged in step S501 whether or not it is the fuel injection amount computation time. If not the computation time, the process is finished. If the computation time it advances to step S502. In step S502 the current intake pressure Pm is introduced and in step S503 the cooling water temperature TW is introduced. In step S504 the intake pressure change amount dPm is obtained from the intake pressure Pm introduced in step S504 and the previously introduced intake pressure Pm0 (dPm←Pm−Pm0).

Thereafter the process advances to step S505 and the first-order lag value dPmn of the intake pipe pressure change amount is computed from the following equation.

$$dPmn=\{(a-1)dPmn0+dPmn\}/a \quad (48)$$

In the next step S506 the cooling water temperature correction value kair is obtained from the map shown in FIG. 12 according to the cooling water temperature TW introduced in step S503. Then, in step S507 the fuel injection correction amount gair with respect to the disparity amount ΔQ of the introduced air amount is computed from the following equation.

$$gair=kh\bullet dPmn\bullet(1+kair) \quad (49)$$

Here, kh is a conversion constant for converting the first-order lag value dPmn of the intake pipe pressure change amount to the fuel injection amount. This conversion constant kh is determined by the size etc. of the injector.

Finally, the currently introduced intake pipe pressure Pm is taken as Pm0 for the current computation, and further, the first-order lag amount Pmn of the currently computed intake pipe pressure change amount is taken as dPmn0 and from here the process is finished. Time charts of when the above process is executed are shown in FIGS. 15(*a*) through 15(*e*). Where acceleration is performed as shown in FIG. 15(*a*), and when a conventional acceleration increase amount only is performed and the correction of the present invention is not performed, the air-fuel ratio is disturbed toward lean as shown in FIGS. 15(*b*) and 15(*c*). However, because correction of the fuel injection amount with respect to the disparity amount of the filling efficiency (introduced air amount) is performed in the present invention, the air-fuel ratio is substantially undisturbed as shown in FIGS. 15(*d*) and 15(*e*).

In the above fifth embodiment, although the disparity amount Δη of the filling efficiency due to a delay in the cylinder internal temperature change is computed from the first-order lag amount dPmn of the intake pipe change amount, a sensor for example may be provided for measuring the cylinder internal temperature T and the disparity amount Δη of the filling efficiency obtained by computation.

Sixth Embodiment

Herebelow, as the sixth embodiment, an embodiment in which the cylinder internal temperature is measured and the fuel injection correction amount gair with respect to the charging efficiency (introduced air amount) disparity portion Δη is obtained using this measured value shall be explained. In the present embodiment a cylinder internal temperature sensor 30 is directly attached to the cylinder as shown in FIG. 16.

FIG. 17 is a flow chart showing a fuel injection correction amount gair computation process in the sixth embodiment. Hereunder the embodiment will be explained according to this flow chart.

Upon this process being executed, in step S601 it is judged whether it is a fuel injection computation time. If not a computation time the process finishes. If a computation time it advances to step S602. In step S602 the intake pressure Pm is introduced and in step S603 the engine rotational speed Ne are introduced. Further, in step S604 a cylinder internal temperature T obtained from the cylinder internal temperature sensor 30 is introduced. Also, in step S605 the cooling water temperature TW is introduced.

Subsequently, in step S606 the charging efficiency ηmap at the time of GFET computation is introduced from the map shown in FIG. 18 from the intake pressure Pm and the engine rotational speed Ne. In the next step S607 the actual charging efficiency η is computed by the following equation.

$$\eta=kt\bullet(Pm/T)\bullet f(\epsilon) \quad (50)$$

Here, kt is a previously determined constant. In step S608 the difference between the actual filling efficiency η computed in step S607 and the mapped filling efficiency ηmap introduced in step S606 is computed (Δη←η−ηmap). In step S609 the water temperature correction coefficient kair is read according to the cooling water temperature. Then, in step S610 the fuel injection correction amount gair is computed from the following equation and the process finishes.

$$gair=kh'\bullet\Delta\eta\bullet(1+kair) \quad (51)$$

Here kh' is a conversion coefficient for converting the charging efficiency η to the fuel injection amount. In the sixth embodiment described above the same effects can be obtained as in the fifth embodiment.

Although in the fifth and sixth embodiments explanation was given with the intake pressure as the load, it is possible to use the introduced air amount or engine rotational speed as the load. In addition, the present invention is not limited to the above embodiments and various modifications can be made thereto without departing from the spirit of the invention.

What is claimed is:

1. A fuel supply amount control apparatus for internal combustion engine, comprising:

a fuel injection valve for injecting fuel into an intake system of the internal combustion engine;

required fuel amount computing means for computing a required fuel amount according to operating conditions of the internal combustion engine;

evaporation time constant computing means for computing an evaporation time constant indicating changes over time of a fuel amount introduced into a cylinder from the intake system after injection of fuel by the fuel injection valve based on a reference evaporation time constant relative to a predetermined reference engine rotational speed and a reference engine load and on engine rotational speed and engine load at a time of evaporation time constant computing;

residual fuel amount computing means for computing a fuel amount remaining in the intake system using the evaporation time constant computed by the evaporation time constant computing means; and fuel injection amount computing means for computing a fuel amount injected from the fuel injection valve, based on a required fuel amount computed by required fuel amount computing means and the residual fuel amount computed by the residual fuel amount computing means.

2. The fuel supply amount control apparatus for internal combustion engine according to claim 1, wherein the fuel injection amount computing means computes a fuel injection amount by means of a pole assignment method.

3. The fuel supply amount control apparatus for internal combustion engine according to claim 1, further comprising:

intake system temperature measuring means for measuring a temperature of the intake system by which fuel is injected;

intake valve temperature measuring means for measuring a temperature of an intake valve of the internal combustion engine;

fuel adhesion portion average temperature computing means for computing an average temperature of fuel adhesion portions by weighted average computation of each temperature of the intake system and intake valve measured by the both temperature measuring means according to an adhesion rate onto the intake system and intake valve of fuel injected from the fuel injection valve; and correction means for correcting the evaporation time constant based on the computed average temperature.

4. The fuel supply amount control apparatus for internal combustion engine according to claim 3, wherein the intake valve temperature measuring means computes an estimated value of the intake valve temperature based on an integrated value of an injected fuel from start of engine operation.

5. The fuel supply amount control apparatus for internal combustion engine according to claim 1, wherein the fuel injection amount computing means computes a correction amount of the fuel injection amount according to a change delay of charging efficiency of air taken into the cylinder at times of fluctuation of the engine load, and the fuel injection amount computing means includes fuel injection amount correction means for correcting the fuel injection amount based on the correction amount.

6. The fuel supply amount control apparatus for internal combustion engine according to claim 5, wherein the fuel injection amount correction means computes a first-order lag amount of the internal combustion engine load and computes a correction amount of the fuel injection amount based on the first-order lag of the internal combustion engine load.

7. The fuel supply amount control apparatus for internal combustion engine according to claim 1, wherein the evaporation time constant computing means computes the evaporation time constant based on an equation $$\tau=\tau 0\bullet(NeO/Ne)\bullet f(Pm)$$

using intake pressure as the engine load, where Ne is an engine rotational speed at a time of computing, Pm is an intake pressure at the time of computing, NeO is the reference engine rotational speed, $\tau 0$ is the reference evaporation time constant at the reference intake pressure Pm0 as the reference engine rotational speed and the reference engine load, and f(Pm) is a rate of change of the evaporation time constant $\tau$ with respect to the intake pressure Pm with the evaporation time constant $\tau$ at the reference intake pressure Pm0 as a reference.

8. The fuel supply amount control apparatus for internal combustion engine according to claim 7, wherein the residual fuel amount computing means computes a residual fuel amount by adding the injection fuel amount injected in one stroke period to a value obtained by multiplying the residual fuel amount from the previous fuel injection by a stroke period Aquino operator $A\alpha$, the stroke period Aquino operator $A\alpha$ being obtained by multiplying in order in the period of one stroke the Aquino operator $\alpha$ computed for each sampling of a time period shorter than an interval between two successive fuel injections to the internal combustion engine, as $$A\alpha=\alpha(t)\bullet\alpha(t-\Delta t)\bullet\alpha(t-2\Delta t)\ldots\alpha(t-n\Delta t)$$

where $\Delta t$ is a sampling period and n is a sampling frequency of one stroke period.

9. The fuel supply amount control apparatus for internal combustion engine according to claim 7, wherein the residual fuel amount computing means computes the residual fuel amount by adding an injection fuel amount to a value obtained by multiplying a residual fuel amount at a previous fuel injection time by an Aquino operator $\alpha$ defined as $\alpha=1-\Delta t/\tau$ where $\Delta t$ is a sampling cycle and $\tau$ is the evaporation time constant.

10. The fuel supply amount control apparatus for internal combustion engine according to claim 9, wherein a computation for computing the evaporation time constant and the fuel injection amount based thereon is executed at the interval of the two fuel injections or at a time interval shorter than the interval of the two fuel injections.

11. The fuel supply amount control apparatus for internal combustion engine according to claim 10, further comprising:

intake system temperature measuring means for measuring a temperature of the intake system of the internal combustion engine; and correction means for correcting the evaporation time constant after engine warm-up operation based on the temperature of the intake system.

* * * * *